US012791187B2

(12) United States Patent
Park

(10) Patent No.: US 12,791,187 B2
(45) Date of Patent: Nov. 10, 2026

(54) SYSTEM OF PREVENTING BACKFLASH IN PRE-MIXED HYDROGEN BURNER AND METHOD THEREOF

(71) Applicants: Hyundai Motor Company, Seoul (KR); Kia Corporation, Seoul (KR)

(72) Inventor: Tae-Heum Park, Gunpo-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 569 days.

(21) Appl. No.: 18/367,521

(22) Filed: Sep. 13, 2023

(65) Prior Publication Data

US 2024/0302041 A1 Sep. 12, 2024

(30) Foreign Application Priority Data

Mar. 7, 2023 (KR) ..... 10-2023-0030084

(51) Int. Cl.
*F23N 5/24* (2006.01)
*F23N 5/18* (2006.01)

(52) U.S. Cl.
CPC ..... *F23N 5/242* (2013.01); *F23N 2005/185* (2013.01); *F23N 2225/06* (2020.01); *F23N 2227/02* (2020.01); *F23N 2227/06* (2020.01); *F23N 2231/28* (2020.01)

(58) Field of Classification Search
CPC ..... F23N 2231/28; F23N 5/242
USPC ..... 60/737; 431/202, 22
See application file for complete search history.

(56) References Cited

U.S. PATENT DOCUMENTS

2014/0147795 A1* 5/2014 Tremblay ..... F23G 7/085 431/5
2024/0255143 A1* 8/2024 Nix ..... F23G 7/085

FOREIGN PATENT DOCUMENTS

KR 10-0784948 B1 12/2007

* cited by examiner

*Primary Examiner* — Vivek K Shirsat
(74) *Attorney, Agent, or Firm* — Morgan, Lewis & Bockius LLP

(57) ABSTRACT

A system for preventing backflash in a pre-mixed hydrogen burner includes a hydrogen burner including a mixture pipe connected to a hydrogen supply flow-path tube along which hydrogen is guided and a combustion air supply flow-path tube along which combustion air is guided, wherein a mixture of the hydrogen and the combustion air is combusted at a combustion nozzle end portion of a pipe connected to the mixture pipe, and a control unit configured to perform a first control to purge the pipe and to interrupt supply of the hydrogen, in a case where backflash propagates or is likely to propagate from the combustion nozzle end portion to the mixture pipe during the combustion.

19 Claims, 23 Drawing Sheets

<FLOWCHART FOR CONFIGURATION OF PREVENTIVE CONTROL AND DETECTION OF BACKFLASH>

(a) Normal combustion (b) Backflash

<FLOWCHART FOR CONFIGURATION OF PREVENTIVE CONTROL AND DETECTION OF BACKFLASH>

<OPERATIONAL CONDITION AND RANGE>

<REAL-TEME PREVENTIVE DETECTION OF BACKFLASH>

<REAL-TIME DETECTION OF OCCURRENCE OF BACKFLASH>

<INTEGRATED DATA RELATING TO DETECTION OF OCCURRENCE OF BACLFLASH>

<RANGE OF WAVELENGTHS OF HYDROGEN FLAME AND LNG (METHANE) FLAME ACCORDING TO EQUIVALENCE RATIO>

<CONFIGURATION OF UV SENSOR FOR INSTALLATION>

※ TWO EXPERIMENTAL DATA ITEMS ARE NOT RESULTS OF SIMULTANEOUS MEASUREMENTS

<COMPARISON BETWEEN EXPERIMETAL RESULTS OF NORMA FLAME AND BACKFLASH>

<FUNDAMENTAL STRUCTURE OF ION PROBER>

<DATA ON BACKFLASH DETECTED BY ION PROBER>

<DATA ON DETECTION OF OCCURRENCE OF BACKLASH BY PRESSURE SENSOR>

<DATA ON DETECTION OF OCCURRENCE
OF BACKLASH BY VIBRATION SENSOR>

<FLOWCHART FOR ADJUSTMENT OF LOAD ON HYDROGEN BURNER>

<FLOWING PATH THAT VARIES ACCORDING TO MODE OF INCREASING TEMPERATURE AND MODE OF DECREASING MODE ON COMBUSTION MAP>

<FLOWCHART FOR REGULATION OF AMOUNT OF FLOWING HYDROGEN AND ADJUSTMENT OF LOAD ON COMBUSTION AIR BLOWER>

<REAL-TEME PREVENTIVE DETECTION OF BACKFLASH>

SYSTEM OF PREVENTING BACKFLASH IN PRE-MIXED HYDROGEN BURNER AND METHOD THEREOF

CROSS-REFERENCE TO RELATED APPLICATION

The present application claims priority to Korean Patent Application No. 10-2023-0030084, Mar. 7, 2023, the entire contents of which is incorporated herein for all purposes by this reference.

BACKGROUND OF THE PRESENT DISCLOSURE

Field of the Present Disclosure

The present disclosure relates to a system of preventing backflash in a pre-mixed hydrogen burner and a method thereof, and more particularly, to a system of preventing backflash in a pre-mixed hydrogen burner and a method thereof which are configured for preventing and minimizing an accident due to the backflash and thus ensuring safety by performing control for prevention of the backflash and detection of the backflash.

Description of Related Art

Various activities have been performed throughout the world to achieve carbon neutrality. To that end, various new and renewable energy developments have been made in the electrical equipment field.

In a painting process for manufacturing vehicles, a large amount of energy is used because liquefied natural gas (LNG) is combusted as is the case with an oven or a booth air-conditioning burner, resulting in a close relationship with emissions of greenhouse gases.

In recent years, to comply with strengthened regulations relating to emission of greenhouse gases to achieve the carbon neutrality that appears as an environmental issue, hydrogen burners that do not generate the greenhouse gases have been proposed as a substitute for an existing LNG burner.

However, due to a high-temperature flame, a large amount of nitrogen oxide (NOx) is generated in the hydrogen burner. A pre-mixture combustion technique is utilized to reduce the large amount of nitrogen oxide (NOx). However, a problem with the present technique is that a backflash phenomenon occurs due to a high-speed flame when hydrogen is combusted, which raises a safety issue.

In other words, the hydrogen burner that employs the pre-mixture technique is comparatively advantageous in complying with the environmental regulations associated with the reduction in the use of nitrogen oxide (NOx), but generates the backflash due to a high-speed hydrogen flame, increasing the likelihood of fire and explosion.

The information included in this Background of the present disclosure is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a system of preventing backflash in a pre-mixed hydrogen burner and a method thereof which are configured for preventing and minimizing an accident caused by the backflash and thus ensuring safety by performing control for prevention of the backflash and detection of the backflash.

To accomplish the above-mentioned object, according to an aspect of the present disclosure, there is provided a system for preventing backflash in a pre-mixed hydrogen burner, the system including: a hydrogen burner including a mixture pipe connected to a hydrogen supply flow-path tube along which hydrogen is guided and a combustion air supply flow-path tube along which combustion air is guided, wherein a mixture of the hydrogen and the combustion air is combusted at a combustion nozzle end portion of a pipe connected to the mixture pipe; and a control unit configured to perform a first control to purge the pipe and to interrupt supply of the hydrogen, in a case where it is detected that backflash propagates from a combustion nozzle end portion to the mixture pipe during the combustion or where a condition for possible occurrence of the backflash is satisfied during the combustion.

According to another aspect of the present disclosure, there is provided a system for preventing backflash in a pre-mixed hydrogen burner, the system including: a hydrogen burner including a mixture pipe connected to a hydrogen supply flow-path tube along which hydrogen is guided and a combustion air supply flow-path tube along which combustion air is guided, wherein a mixture of the hydrogen and the combustion air is combusted at a combustion nozzle end portion of a pipe connected to the mixture pipe; and a control unit configured for measuring in real time an amount of the hydrogen flowing to be supplied and an amount of the combustion air flowing to be supplied and compute an equivalence ratio of the combustion air to the hydrogen to detect in real time whether or not a condition for possible occurrence of the backflash propagating from the combustion nozzle end portion to the first fixture pipe is satisfied, and to purge the pipe, as well as to interrupt supply of the hydrogen, in a case where the determined equivalence ratio satisfies a predetermined backflash boundary condition during the combustion and thus where the condition of possible occurrence of the backflash is satisfied during the combustion.

According to yet another aspect of the present disclosure, there is provided a system for preventing backflash in a pre-mixed hydrogen burner, the system including: a hydrogen burner including a mixture pipe connected to a hydrogen supply flow-path tube along which hydrogen is guided and a combustion air supply flow-path tube along which combustion air is guided, wherein a mixture of the hydrogen and the combustion air is combusted at a combustion nozzle end portion of a pipe connected to the mixture pipe; a backflash-detection pressure sensor, a backflash-detection vibration sensor, a backflash-detection ion prober, and a backflash detection and spark detection sensor that are sequentially provided in a front and rear direction with respect to the pipe to detect in real time that the backflash propagates from the combustion nozzle end portion to the mixture pipe during the combustion; and a control unit configured to perform a first control in such as manner as to purge the pipe, as well as to interrupt supply of the hydrogen when it is detected that the backflash propagates from the combustion nozzle end portion to the mixture pipe.

In the system, the backflash-detection pressure sensor may be connected to the hydrogen supply flow-path tube.

In the system, the backflash-detection vibration sensor may be provided on a surface of an external casing of the hydrogen burner.

In the system, the backflash-detection ion prober may be provided on a second pipe that connects a first pipe including the combustion nozzle end portion and the mixture pipe to each other.

In the system, the backflash detection and spark detection sensor may be provided to face toward the combustion nozzle end portion, that is, toward a point where a hydrogen flame is produced.

In the system, the backflash detection and spark detection sensor may be an ultraviolet (UV) sensor, or an infrared (IR) sensor.

In the system, the amount of the hydrogen flowing to be supplied may be measured by any one of a flowing-fluid speed sensor, a pressure sensor, and a mass sensor and is regulated by a fluid control valve, and the amount of the combustion air flowing to be supplied may be measured by any one of the flowing-fluid speed sensor, the pressure sensor, and the mass sensor and may be regulated by any one of an inverter, a damper, and a brushless DC (BLDC) motor.

In the system, when it is determined that the backflash does not propagate during the combustion or when it is determined that the condition for possibility for occurrence of backflash is not satisfied during the combustion, the controller may perform a second control that adjusts a load on the hydrogen burner.

According to yet another of the present disclosure, there is provided a method of preventing backflash in a pre-mixed hydrogen burner in the system for preventing backflash in a pre-mixed hydrogen burner, the method including: a step S20 of preparing ignition of the hydrogen burner by supplying the hydrogen and the combustion air to the pipe; a step S21 of performing the ignition of the hydrogen burner; a step S22 of completing the ignition of the hydrogen burner, the first control being performed in the completing in a case where the hydrogen burner fails to be ignited; and a step of S24 of determining an equivalence ratio when the hydrogen burner is ignited, wherein the backflash boundary condition is categorized in a manner that corresponds to a safety range in which a result of the computation of the equivalence ratio is equal to or greater than 0% and smaller than 75% when compared against a predetermined reference safety ratio, a warning range in which the result of the computation of the equivalence ratio is equal to or greater than 75% and smaller than 90% when compared against the predetermined reference safety ratio, and a risk range in which the result of the computation of the equivalence ratio is equal to or greater than 90% and equal to or smaller than 100% when compared against the predetermined reference safety ratio, and wherein in a case where the backflash boundary condition corresponds to the warning range, returning to the S24 of determining the equivalence ratio takes place, and wherein in a case where the backflash boundary condition corresponds to the warning range corresponds to the risk range, the first control is performed.

The method may further include a step S25 of determining whether or not a combustion air blower normally operates, the first control being performed in the step S25 in a case where the backflash boundary condition corresponds to the safety range and where it is determined that the amount of the combustion air flowing to be supplied is at or below a predetermined value; and a step S26 of determining whether or not pressure for supplying hydrogen is abnormal, the first control being performed in the step S26 in a case where the combustion air blower operates normally and where it is determined that the pressure for supplying the hydrogen exceeds a predetermined an upper limit of a permissible range.

In the method, the pressure for supplying the hydrogen may be pressure between a first regulator provided on a hydrogen supply pipe connected to a hydrogen storage unit in which the hydrogen is stored and the hydrogen burner.

According to yet another of the present disclosure, there is provided a method of preventing backflash in a pre-mixed hydrogen burner in the system for preventing backflash in a pre-mixed hydrogen burner, the method including: a step S30 of preparing ignition of the hydrogen burner by supplying the hydrogen and the combustion air, which are pre-mixed, to the pipe; a step S31 of performing the ignition of the hydrogen burner; and a step S32 of completing the ignition of the hydrogen burner, the first control being performed in the completing in a case where the hydrogen burner fails to be ignited, wherein in a case where the hydrogen burner is ignited, when the backflash detection and spark detection sensor does not detect a flame that results from the combustion or when any one of the backflash-detection ion prober, the backflash-detection vibration sensor, and the backflash-detection pressure sensor is configured to detect that the backflash occurs, the first control is performed.

In the method, the second control may perform: a step S52 of performing load adjustment, in which an amount of load on the hydrogen burner is determined using a difference between a temperature measured at a predetermined target point in the hydrogen burner and a predetermined temperature value; a step S55 of performing control using the upper limit of amounts of change in a load rate, in which an amount of change in load is adjusted to a maximum of 20% when an absolute value of the amount of change in load exceeds a predetermined upper limit; a step S56 of determining an increase in temperature and a decrease in temperature, in which an amount of change in load that indicates a difference between an amount of load which is newly determined and an amount of load which is determined just previously is determined; and a step of regulating the amount of the combustion air flowing to be supplied earlier than the amount of the hydrogen flowing to be supplied when the absolute value of the amount of change in load is greater than 0, and regulating the amount of the hydrogen flowing to be supplied earlier than the amount of the combustion air flowing to be supplied when the absolute value of the amount of change in load is smaller than 0.

In the method, an alarm may be set off in a case where it takes a predetermined time period or longer to receive a feedback signal after the second control starts.

The present disclosure provides the following effects.

Firstly, control may be performed for prevention of the backflash and detection of the backflash may be achieved. Thus, the effect of preventing and minimizing an accident due to the backflash and thus ensuring safety may be achieved.

Secondly, various current conditions and condition values to be changed may be checked and predicted before the backflash boundary condition (a reference equivalence ratio) is reached. Accordingly, preventive control for avoiding a condition in which the backflash occurs may be performed. Thus, the stability of the hydrogen burner may be ensured by preventing the backflash.

Thirdly, the occurrence of the backflash may be rapidly detected in various ways using various sensors (the backflash-detection UV sensor, the backflash-detection ion prober, the backflash-detection vibration sensor, and the backflash-detection pressure sensor) in the hydrogen burner. Accordingly, a subsequent fire and a possible explosion accident due to the occurrence of the backflash may be prevented. Thus, the advantage of securing the stability of the hydrogen burner may be achieved.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
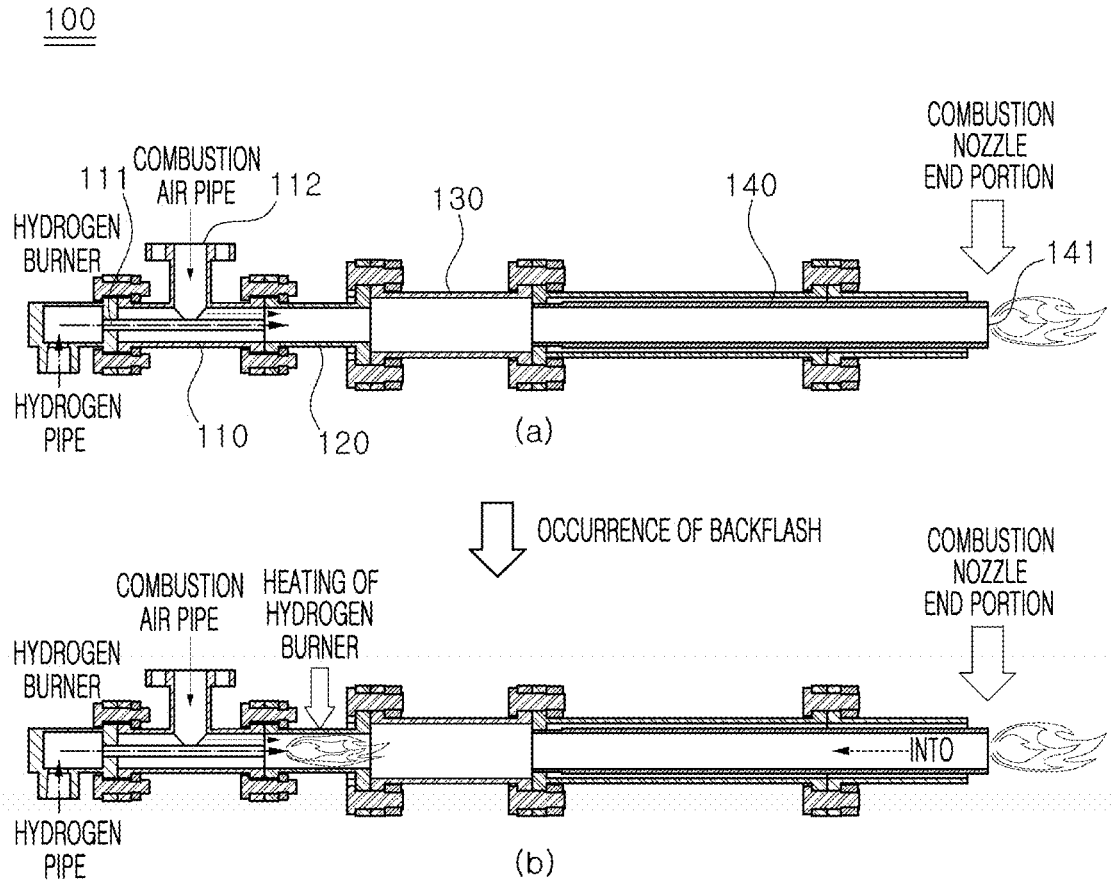
FIG. 1A is a schematic vertical cross-sectional view exemplarily illustrating a normal state of a hydrogen burner according to various exemplary embodiments of the present disclosure.
FIG. 1B is a schematic vertical cross-sectional view exemplarily illustrating a state where backflash occurs.

It may be understood that the appended drawings are not necessarily to scale, presenting a somewhat simplified representation of various features illustrative of the basic principles of the present disclosure. The predetermined design features of the present disclosure as included herein, including, for example, specific dimensions, orientations, locations, and shapes will be determined in part by the particularly intended application and use environment.

In the figures, reference numbers refer to the same or equivalent portions of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

The present disclosure may be practiced in various ways. Exemplary embodiments of the present disclosure will be described in detail with reference to the drawings. However, the present disclosure is not intended to be limited to the desired embodiments. All modifications, equivalents, and substitutes that are included within the scope of the technical idea of the present disclosure should be understood as falling within the scope of the present disclosure.

The same constituent element is provided the same reference numeral in each of the drawings that is referred to for description.

The terms first, second, and the like are used to describe various constituent elements, but should not impose any limitation on the meanings of the constituent elements. These terms are used only to distinguish one constituent element from another.

For example, a first constituent element may be named a second constituent element without departing from the scope of the present disclosure. In the same manner, the second constituent element may also be named the first constituent element. The term "and/or" is used to join two words, phrases, or sentences or to refer to one of the two words, one of two phrases, or one of two sentences.

Unless otherwise defined, all terms, including technical or scientific terms, which are used in the present specification, include the same meanings as are normally understood by a person of ordinary skill in the art to which the present disclosure pertains.

The term as defined in a dictionary in general use should be construed as including the same meaning as interpreted in context in the relevant technology, and unless otherwise explicitly defined in the present specification, is not construed as including a connotative meaning or a full literal meaning.

Terms that are used in the present specification are defined as follows.

The term "rear direction" means a direction of a rear portion of a path from a point to which a fluid is supplied to a point from which the fluid is finally discharged. For example, in FIG. 3, a combustion nozzle end portion 141 from which a flame is discharged is positioned in the rear direction, and a hydrogen storage unit 300 is positioned in the front direction thereof.

As an exemplary embodiment of the present disclosure, a first pipe 140 in the rear direction is connected to a second pipe 130, and the second pipe 130 in the rear direction is connected to a first mixture pipe 110. The front direction is a direction which is opposite to the rear direction thereof.

The term "lateral direction" means a direction perpendicular to an imaginary line that connects a point in the front direction and a point in the rear direction to each other. For example, in FIG. 3, a combustion air supply flow-path tube 112 is formed in the lateral direction with respect to a first mixture pipe 110.

Furthermore, the rear direction may indicate the order of connection. For example, in FIG. 3, a hydrogen storage unit 300, a pressure sensor 511, a first regulator 801, and a second backflash prevention valve 712 are sequentially connected starting from the frontmost component in the front direction, ending at the rearmost component in the rear direction thereof.

The term "abnormality," or "abnormality detection" may mean a state where a condition for possibility for occurrence of backflash is satisfied or a state where occurrence of backflash is detected. The term "normality," or "no abnormality" may mean a state where the condition for possibility for occurrence of backflash is not satisfied or a state where occurrence of backflash is not detected.

The term "blower" may mean a device that applies a blowing force to combustion air.

FIG. 1A and FIG. 1B are views each illustrating a hydrogen burner 100 according to various exemplary embodiments of the present disclosure. FIG. 1A is a view exemplarily illustrating a normal combustion state. FIG. 1B is a view exemplarily illustrating a phenomenon where the backflash occurs and thus a flame propagates from the combustion nozzle end portion 141 toward the first mixture pipe 110.

The hydrogen burner 100 may include the first mixture pipe 110, a third pipe 120, the second pipe 130, and the first pipe 140.

Figure 2A:
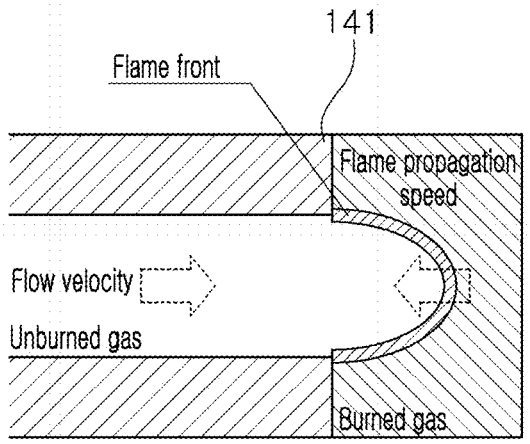
FIG. 2A and FIG. 2B are schematic views that are referred to for description of normal combustion (a) and backflash (b), respectively, in a combustion nozzle end portion according to the various exemplary embodiments of the present disclosure.
Figure 2B:
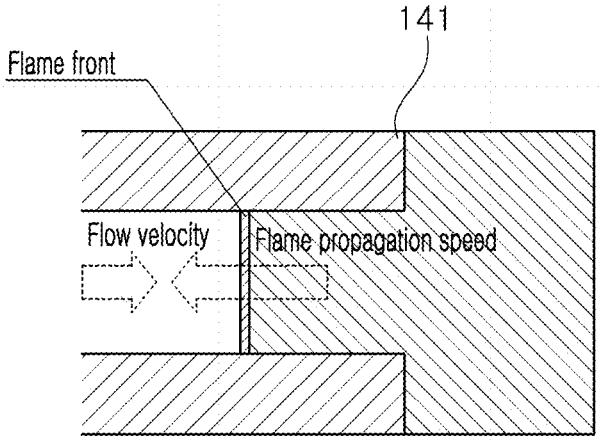

The first mixture pipe 110 may include a hydrogen supply flow-path tube 111 and the combustion air supply flow-path tube 112 on one side thereof where hydrogen is supplied to the hydrogen supply flow-path tube 111, and the combustion air is provided to the combustion air supply flow-path tube 112. Gas pre-mixed with the hydrogen and the combustion air may flow to the third pipe 120, the second pipe 130, and the first pipe 140 in the present order and may be discharged through the combustion nozzle end portion 141 where a flame is generated. The third pipe 120 is connected to the first mixture pipe 110, and the second pipe 130 connects the third pipe 120 and the first pipe 140 to each other. FIG. 2A is a view exemplarily illustrating normal combustion in the combustion nozzle end portion 141 according to the various exemplary embodiments of the present disclosure. FIG. 2B is a view exemplarily illustrating a backflash phenomenon in the combustion nozzle end portion 141.

The backflash may refer to a phenomenon where, as illustrated in FIG. 2B, the flame propagates in a reverse direction from the combustion nozzle end portion 141 to inside of the first pipe 140.

Figure 3:
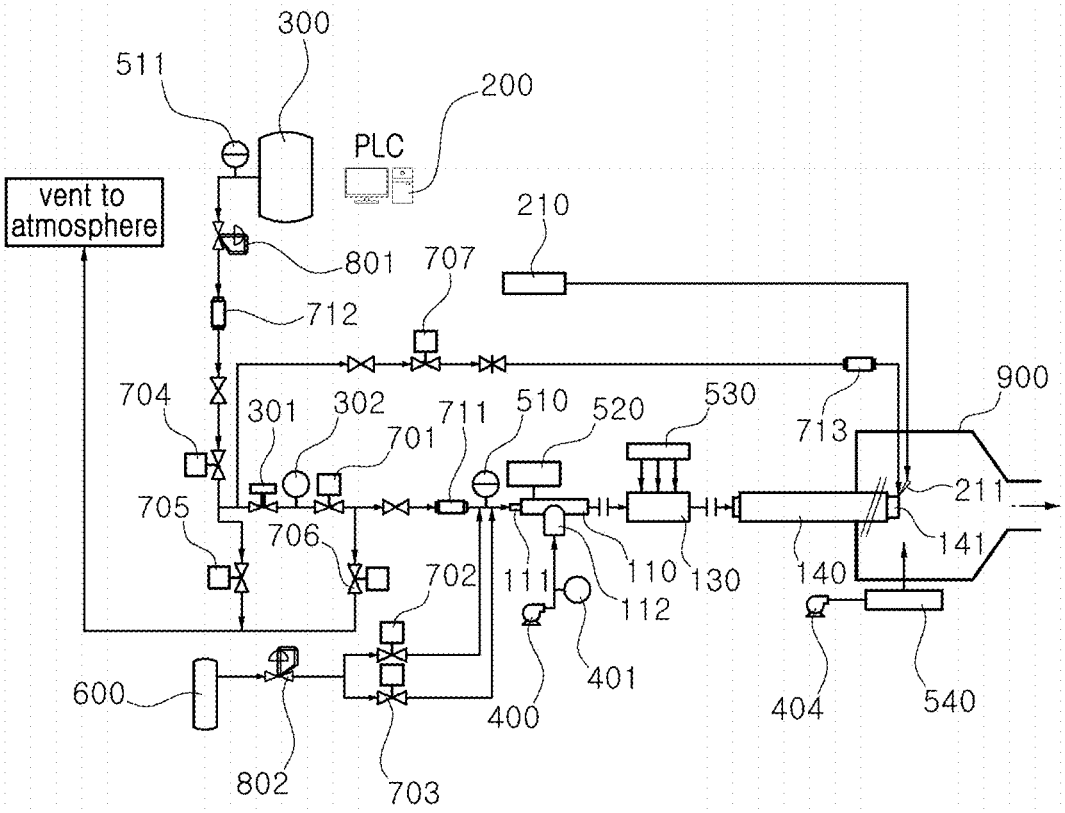
FIG. 3 is a view schematically illustrating a configuration of an entire system according to the various exemplary embodiments of the present disclosure.

FIG. 3 is a view schematically illustrating a configuration of an entire system according to the various exemplary embodiments of the present disclosure.

The first mixture pipe 110 may be where hydrogen gas and the combustion air are mixed. The hydrogen supply flow-path tube 111 may be provided on one side of the first mixture pipe 110. A combustion air blower 400 that provides the combustion air to the first mixture pipe 110 may be connected to the combustion air supply flow-path tube 112.

The combustion air blower 400 is configured to supply the combustion air to combust hydrogen and may include an inverter (INV). In the instant case, a sensor 401 for detecting an amount of combustion air flowing to be supplied may be provided between the combustion air supply flow-path tube 112 and the combustion air blower 400 such which is connected thereto and may check the amount of combustion air flowing to be supplied.

A first backflash prevention valve 711 may be connected to the hydrogen supply flow-path tube 111. A backflash-detection pressure sensor 510 may be provided between the first backflash prevention valve 711 and the backflash-detection vibration sensor 520 in a manner which is connected to them.

In a case where the backflash occurs, residual gas present in a combustion pipe inside the hydrogen burner 100 may have to be purged, and a purging device is configured to purge the residual gas. In other words, the purging device may include a purge tank 600, a second solenoid valve 702, a third solenoid valve 703, and a second regulator 802.

High-pressure inert gas may be stored in the purge tank 600. Examples of the inert gas may include helium or nitrogen gas. The second regulator 802 may be connected to the purge tank 600. The second regulator 802 may regulate the pressure of gas to be purged.

One side of the second solenoid valve 702 may be connected to the second regulator 802, and the other side thereof may be connected to the first backflash prevention valve 711 and the backflash-detection pressure sensor 510 in a manner which is positioned therebetween.

One side of the third solenoid valve 703 may be connected to the second regulator 802, and the other side thereof may be connected to the hydrogen supply flow-path tube 111 and the backflash-detection pressure sensor 510 in a manner which is positioned therebetween.

In other words, the second solenoid valve 702 may be connected to the backflash-detection pressure sensor 510 in the front direction of the backflash-detection pressure sensor 510, and the third solenoid valve 703 may be connected to the backflash-detection pressure sensor 510 in the rear direction of the backflash-detection pressure sensor 510.

The second pipe 130 may be connected to the first mixture pipe 110 in the rear direction of the first mixture pipe 110. The first pipe 140 may be connected to the second pipe 130 in the rear direction of the second pipe 130. The combustion nozzle end portion 141 may form a rear end portion of the first pipe 140. Through the combustion nozzle end portion 141, the gas that results from pre-mixing may be discharged, and the flame may be emitted therefrom. The combustion nozzle end portion 141 may be positioned inside a combustion chamber 900.

The ignition plug 211 may be provided inside the combustion chamber 900 in a manner which is positioned adjacent to the combustion nozzle end portion 141. The ignition coil 210 may be connected to the ignition plug 211 and is configured as an ignition trigger.

A backflash detection unit which is configured to detect occurrence of the backflash may be provided in the hydrogen burner 100. The backflash detection unit may be connected to a control unit 200.

Conceptually, the control unit 200 is configured as an integrated control device for a control to prevent the backflash and to detect the occurrence thereof in the hydrogen burner 100.

The backflash detection units may include at least one of the backflash-detection pressure sensor 510, the backflash-detection vibration sensor 520, a backflash-detection ion prober 530, and a backflash detection and spark detection sensor 540.

The backflash-detection pressure sensor 510 may be connected to a hydrogen supply flow-path tube 111 and thus may be connected to an external pipe connected to the combustion pipe. That is, the backflash-detection pressure sensor 510 may detect a change in the pressure inside a burner hydrogen supply pipe which is generated when the backflash occurs and may be configured to determine whether or not the backflash occurs.

The backflash-detection vibration sensor 520 may be provided on a surface of an external casing of the hydrogen burner 100. The backflash-detection vibration sensor 520 may detect vibration of the hydrogen burner 100 due to an impact wave which is generated when the backflash occurs, determining whether or not the backflash occurs.

The backflash-detection ion prober 530 may be provided on the second pipe 130. The backflash-detection ion prober 530 may detect whether the flame occurs, using electric current which is conducted by ions that occur in a backflash flame inside the combustion pipe.

The backflash detection and spark detection sensor 540 may be provided to face the combustion nozzle end portion 141 and may be directly exposed to the flame discharged from the combustion nozzle end portion 141. In other words, the backflash detection and spark detection sensor 540 may be a UV sensor which is configured for detecting infrared light with a UV wavelength that occurs in a flame produced by combusted hydrogen.

A blower 404 for cooling the backflash detection and spark detection sensor 540 may cool the backflash detection and spark detection sensor 540 by blowing air to the backflash detection and spark detection sensor 540, and may protect the backflash detection and spark detection sensor 540 from being heated to a high temperature. In an exemplary embodiment of the present disclosure, high-pressure air can be substituted for the blower 404 for cooling the backflash detection and spark detection sensor 540.

Hydrogen may be stored in the hydrogen storage unit 300. The hydrogen storage unit 300 may provide hydrogen that flows along a hydrogen supply line to the hydrogen burner 100.

The pressure sensor 511, the first regulator 801, the second backflash prevention valve 712, a fourth solenoid valve 704, a sensor 301 for detecting an amount of hydrogen flowing to be supplied, a valve 302 for regulating an amount of hydrogen flowing to be supplied, a first solenoid valve 701, a sixth solenoid valve 706, the first backflash prevention valve 711, the backflash-detection pressure sensor 510, and the hydrogen supply flow-path tube 111 may be provided on the hydrogen supply line starting from the frontmost component in the front direction, ending at the rearmost component in the rear direction thereof.

The pressure sensor 511 may be connected to the hydrogen storage unit 300 and may check pressure of hydrogen inside the hydrogen storage unit 300.

The first regulator 801 may be provided between the hydrogen storage unit 300 and the hydrogen burner 100. The first regulator 801 may possibly control a supplying pressure of the hydrogen to the hydrogen burner 100. The second backflash prevention valve 712 may be connected to the first regulator 801 and may block the possible propagation of backflash into the hydrogen storage unit 300.

The sensor 301 for detecting an amount of hydrogen flowing to be supplied may be provided between the second backflash prevention valve 712 and the first backflash prevention valve 711. The sensor 301 for detecting an amount of hydrogen flowing to be supplied may be a sensor configured for measuring an amount of flowing hydrogen which is supplied to the hydrogen burner 100.

The valve 302 for regulating an amount of hydrogen flowing to be supplied in the rear direction, may be connected to the sensor 301 for detecting an amount of hydrogen flowing to be supplied.

The first solenoid valve 701 may be connected to the valve 302 in the rear direction of the valve 302 for regulating an amount of hydrogen flowing to be supplied. The first solenoid valve 701 may be provided to block supplying of hydrogen when a flame failure occurs or when the backflash occurs. An additional valve 730 may be provided between the first solenoid valve 701 and the first backflash prevention valve 711.

The sixth solenoid valve 706 may be connected to the first solenoid valve 701 in the rear direction of the first solenoid valve 701. The sixth solenoid valve 706 may be connected to the valve 730 between the first backflash prevention valve 711 and the first solenoid valve 701 in the front direction of the valve.

The fourth solenoid valve 704 may be connected to the second backflash prevention valve 712 in the rear direction of the second backflash prevention valve 712. A valve 740 may be provided between the second backflash prevention valve 712 and the fourth solenoid valve 704.

One end portion of a seventh solenoid valve 707 may be positioned between the fourth solenoid valve 704 and the sensor 301 for detecting an amount of hydrogen flowing to be supplied. The other end portion thereof may be connected to a third backflash prevention valve 713 connected to the combustion nozzle end portion 141.

The third backflash prevention valve 713 may also block the propagation of the backflash from the combustion nozzle end portion 141 toward the hydrogen storage unit 300.

The seventh solenoid valve 707 and the third backflash prevention valve 713 may be positioned on an ignition line pipe 760. Valves 762 and 764 may be provided to be connected to the seventh solenoid valve 707 in the front direction and the rear direction of the seventh solenoid valve 707, respectively. In other words, the valve 762 may be provided between the seventh solenoid valve 707 and the sensor 301 for detecting an amount of hydrogen flowing to be supplied, and the valve 764 may be provided between the seventh solenoid valve 707 and the third backflash prevention valve 713.

The fourth solenoid valve 704 may be connected to the valve 740 which is in the rear direction of the second backflash prevention valve 712 and connected to the second backflash prevention valve 712. A fifth solenoid valve 705 may be connected to a fourth solenoid valve 704. The fifth solenoid valve 705 and the sixth solenoid valve 706 may be connected to a vent line pipe 750. In other words, one end portion of the vent line pipe 750 may be exposed to the atmosphere, and the other end portion thereof may be connected to each of the fifth solenoid valve 705 and the sixth solenoid valve 706 in parallel.

Next, a method preventive control and detection of the backflash and according to various exemplary embodiments of the present disclosure is described with reference to FIG. 4.

A step S10 of preparing ignition of the hydrogen burner 100 may be performed in a system for preventively detecting backflash and detecting occurrence of the backflash in a pre-mixed hydrogen burner. Hydrogen may be provided from the hydrogen storage unit 300 to the hydrogen supply flow-path tube 111, and combustion air may be provided to the first mixture pipe 110 through the combustion air supply flow-path tube 112. Hydrogen may be pre-mixed with the combustion air in the first mixture pipe 110 and may be provided to the hydrogen burner 100.

In a step S11 of performing the ignition of the hydrogen burner 100, when the control unit 200 causes a spark in the ignition plug 211 through the ignition coil 210, a flame may be injected into the combustion chamber 900 through the combustion nozzle end portion 141.

A normal flame, as illustrated in FIG. 2A, may occur only from an orifice of the combustion nozzle end portion 141, and undergo a step S12 of completing the ignition of the hydrogen burner 100. When the hydrogen burner 100 fails to be ignited in the step S12 of completing the ignition of the hydrogen burner 100, a step S18 of interrupting hydrogen supply and a step S19 of purging the combustion pipe may be sequentially performed, and proceeding to the step S10 of preparing ignition of the hydrogen burner 100 may take place.

When the hydrogen burner 100 succeeds in being ignited in the step S12 of completing the ignition of the hydrogen burner 100, hydrogen may be pre-mixed with the combustion air in the first mixture pipe 110 of the hydrogen burner 100 and may be provided for ignition. At the present point, when the hydrogen burner 100 succeeds in being ignited in the step S12 of completing the ignition of the hydrogen burner 100, a step S13 of preventively detecting the backflash and a step S14 of detecting the occurrence of the backflash may be performed in real time at the same time.

In the step S13 of preventively detecting the backflash, the control unit 200 may compute an equivalence ratio based on a value of hydrogen flowing to be supplied and an amount of combustion air flowing to be supplied that are measured in real time, determine whether or not a current combustion state satisfies a backflash boundary condition with the equivalence ratio as a reference, and perform a control for preventing the backflash.

In the step S14 of detecting the occurrence of the backflash, the occurrence of the backflash may be detected in real time by the backflash detection unit provided in the hydrogen burner 100. A step S15 of determining whether or not the backflash in the hydrogen burner 100 is abnormal may be performed through the step S13 of preventively detecting the backflash and the step S14 of detecting the occurrence of the backflash. At the present point, when the control unit 200 and the backflash detection unit determine, in the step S15 of determining whether or not the backflash in the hydrogen burner 100 is abnormal, that the condition for possibility for occurrence of backflash in the hydrogen burner 100 is satisfied or that the backflash occurs, the step S18 of interrupting hydrogen supply and the step S19 of purging the combustion pipe may be sequentially performed, and proceeding to the step S10 of preparing ignition of the hydrogen burner 100 takes place.

That is, when it is detected, in the step S15 of determining whether or not the backflash in the hydrogen burner 100 is abnormal, that an abnormality occurs, the supplying of hydrogen may be interrupted, and the combustion pipe of the hydrogen burner 100 may be purged using the purging device. This interruption and purging may be referred to as first control. That is, the first control means a control to, when the abnormality is detected, perform the step S19 of purging the combustion pipe after the step S18 of interrupting hydrogen supply is performed.

When the control unit 200 and the backflash detection unit determine, in the step S15 of determining whether or not the backflash in the hydrogen burner 100 is abnormal, that the occurrence of the backflash is not detected or that the condition for possibility for occurrence of backflash is not satisfied, a load on the hydrogen burner 100 may be adjusted based on a change ratio of the amount of hydrogen flowing to be supplied and a change ratio of the amount of combustion air flowing to be supplied. The present adjustment is referred to as second control.

In other words, when it is determined, in the step S15 of determining whether or not the backflash in the hydrogen burner 100 is abnormal, that no abnormality occurs, the second control may be performed. A step S16 of adjusting a load to prevent the backflash corresponds to the second control. A step S17 of completing load adjustment may be performed when load adjustment succeeds in preventing the backflash in the step S16 of adjusting a load to prevent the backflash.

The backflash boundary condition is determined by determining the equivalence ratio based on the amount of hydrogen flowing to be supplied and the amount of combustion air flowing to be supplied. The equivalence ratio may refer to an index indicating a relative amount of air with respect to the mass of a fuel. At the present point, the backflash boundary condition may be categorized by a result of the computation of the equivalence ratio as a safety range, a warning range, or a risk range.

Figure 5:
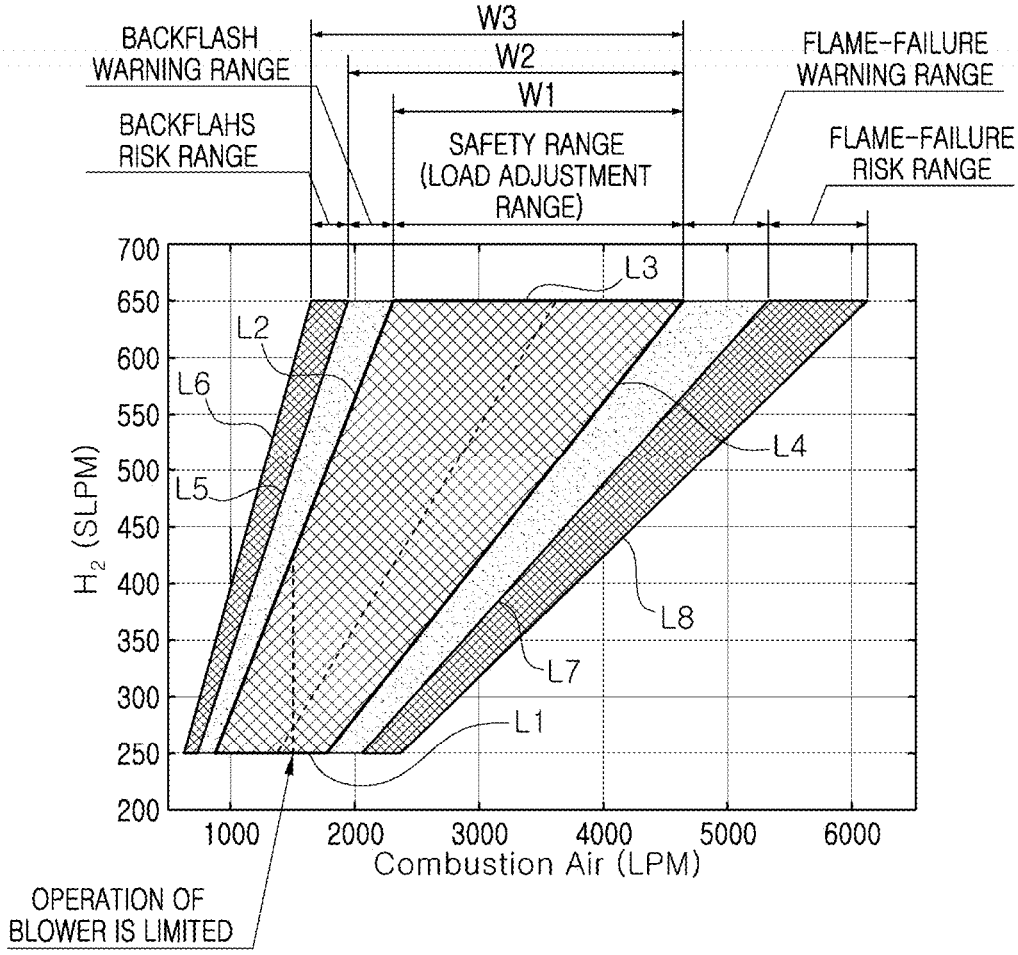
FIG. 5 is a graph showing an operational condition and range according to the various exemplary embodiments of the present disclosure.

FIG. 5 is a graph showing an operational condition and range according to the various exemplary embodiments of the present disclosure. In other words, FIG. 5 also illustrates the backflash boundary condition.

The safety range may be a range W1 where the result of the computation of the equivalence ratio is equal to or greater than 0% and smaller than 75% when compared against a predetermined reference safety ratio. The warning range may be a range W2 where the result of the computation of the equivalence ratio is equal to or greater than 75% and smaller than 90% when compared against the predetermined reference safety ratio. The risk range may be a range W3 where the result of the computation of the equivalence ratio is equal to or greater than 90% and equal to or smaller than 100% when compared against the predetermined reference safety ratio.

In FIG. 5, the horizontal axis represents an amount (LPM) of flowing combustion air that results from combustion of pre-mixed hydrogen, and the vertical axis represents an amount (SLPM) of hydrogen flowing to be suppled.

The safety range may mean a range of amounts of flowing hydrogen and combustion air which is indicated by L1, L2, L3, and L4. A backflash-warning range may be a region between L2 and L5. A backflash-risk range may be a region between L5 and L6. A flame-failure warning range may be an area between L4 and L7, and a flame-failure risk region may be a region between L7 and L8. Therefore, the hydrogen burner 100 has to operate in the safety range.

Figure 6:
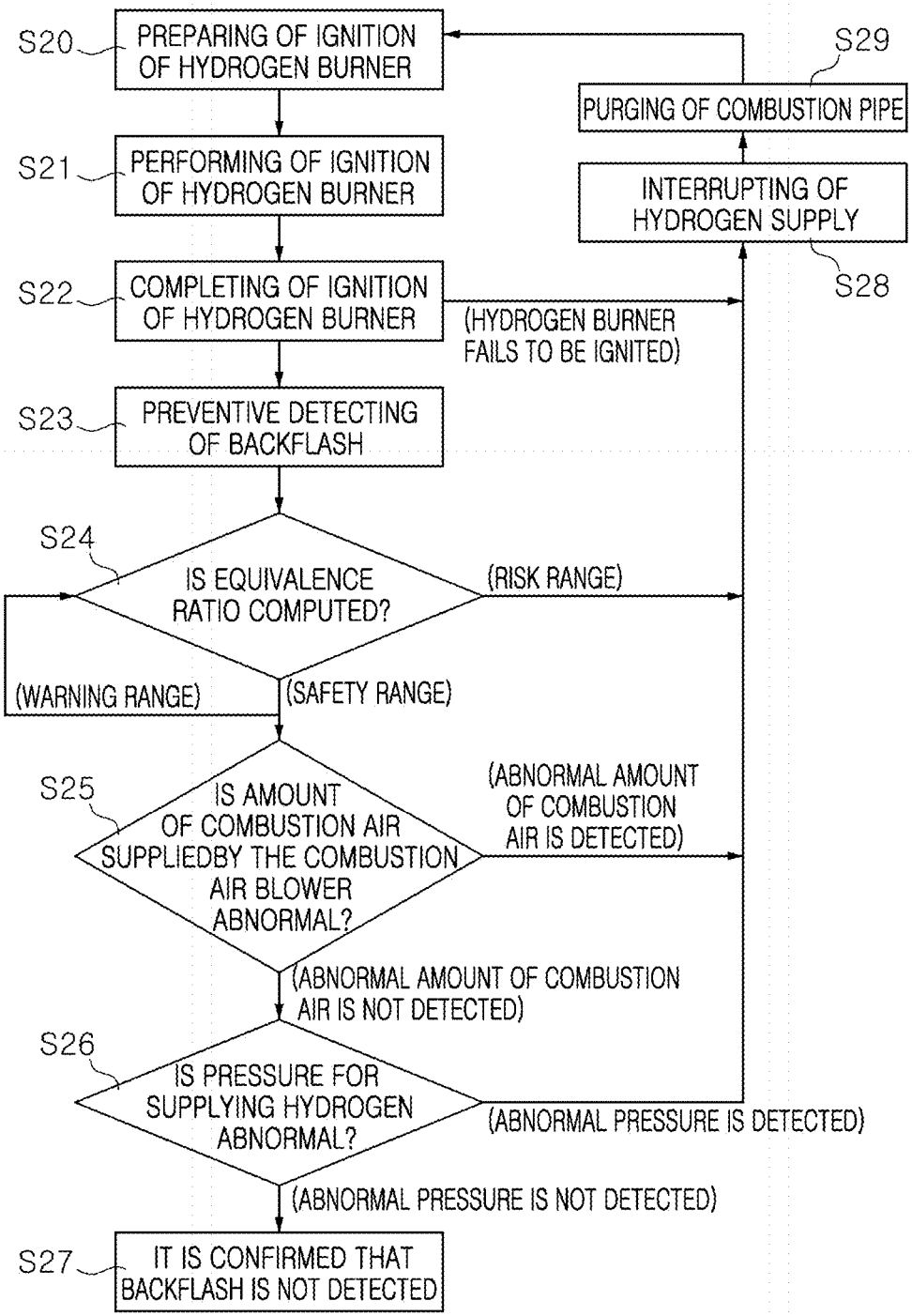
FIG. 6 is a flowchart for real-time preventive detection of the backflash according to the various exemplary embodiments of the present disclosure.

FIG. 6 is a flowchart for real-time preventive detection of the backflash according to the various exemplary embodiments of the present disclosure.

A step S20 of preparing the burner ignition, a step S21 of performing burner ignition, and a step S22 of completing the ignition of the hydrogen burner 100 may be performed in a time series in the same manner as the step S10 of preparing ignition of the hydrogen burner 100, the step S11 of performing the ignition of the hydrogen burner 100, and the step S12 of completing the ignition of the hydrogen burner 100.

Furthermore, when the hydrogen burner 100 fails to be ignited in the step S22 of completing the ignition of the hydrogen burner 100, a step S28 of interrupting hydrogen supply, a step S29 of purging the combustion pipe, and a step S20 of preparing the burner ignition may be performed in a time series in the same manner as the step S18 of interrupting hydrogen supply, the step S19 of purging the combustion pipe, and the step S10 of preparing ignition of the hydrogen burner 100 that are described above.

A step S23 of preventively detecting the backflash may be in real time performed after the step S22 of completing the ignition of the hydrogen burner 100 is performed and then a step S24 of determining the equivalence ratio may be performed. In the step S24 of determining the equivalence ratio, the equivalence ratio may be determined according to an equation for determining the equivalence ratio, and thus the above-described backflash boundary condition is determined.

When the backflash boundary condition corresponds to the risk range, the step S28 of interrupting hydrogen supply, the step S29 of purging the combustion pipe, and the step S20 of preparing the burner ignition may be performed. When the backflash boundary condition corresponds to the warning range, a mandatory control may be performed with the immediately preceding amount of hydrogen flowing to be supplied and the immediately preceding amount of combustion air flowing to be supplied, and thus the step S24 of determining the equivalence ratio may be re-performed. When the backflash boundary condition corresponds to the safety range, a step S25 of determining whether or not the combustion air blower 400 operates abnormally may be performed.

When it is determined, in the step S25 of determining whether or not the combustion air blower 400 operates abnormally, that the combustion air blower 400 operates abnormally, the step S28 of interrupting hydrogen supply, the step S29 of purging the combustion pipe, and the step S20 of preparing the burner ignition may be performed.

When it is not detected, in the step S25 of determining whether or not the combustion air blower 400 operates abnormally, that the combustion air blower 400 operates abnormally, that is, that the combustion air blower 400 operates normally, a step S26 of determining whether or not pressure for supplying hydrogen is abnormal may be performed. When it is detected, in the step S26 of determining whether or not pressure for supplying hydrogen is abnormal, that the pressure for supplying hydrogen is abnormal, the step S28 of interrupting hydrogen supply, the step S29 of purging the combustion pipe, and the step S20 of preparing the burner ignition may be performed.

When it is not detected, in the step S26 of determining whether or not pressure for supplying hydrogen is abnormal, that the pressure for supplying hydrogen is abnormal, that is, that pressure for supplying hydrogen is normal, a step S27 of checking that the backflash is not detected may be performed. Accordingly, control and monitoring are regularly performed after the burner ignition may be performed.

In an exemplary embodiment of the present disclosure, the order of S25 and S26 may not necessarily be in sequence.

Figure 7:
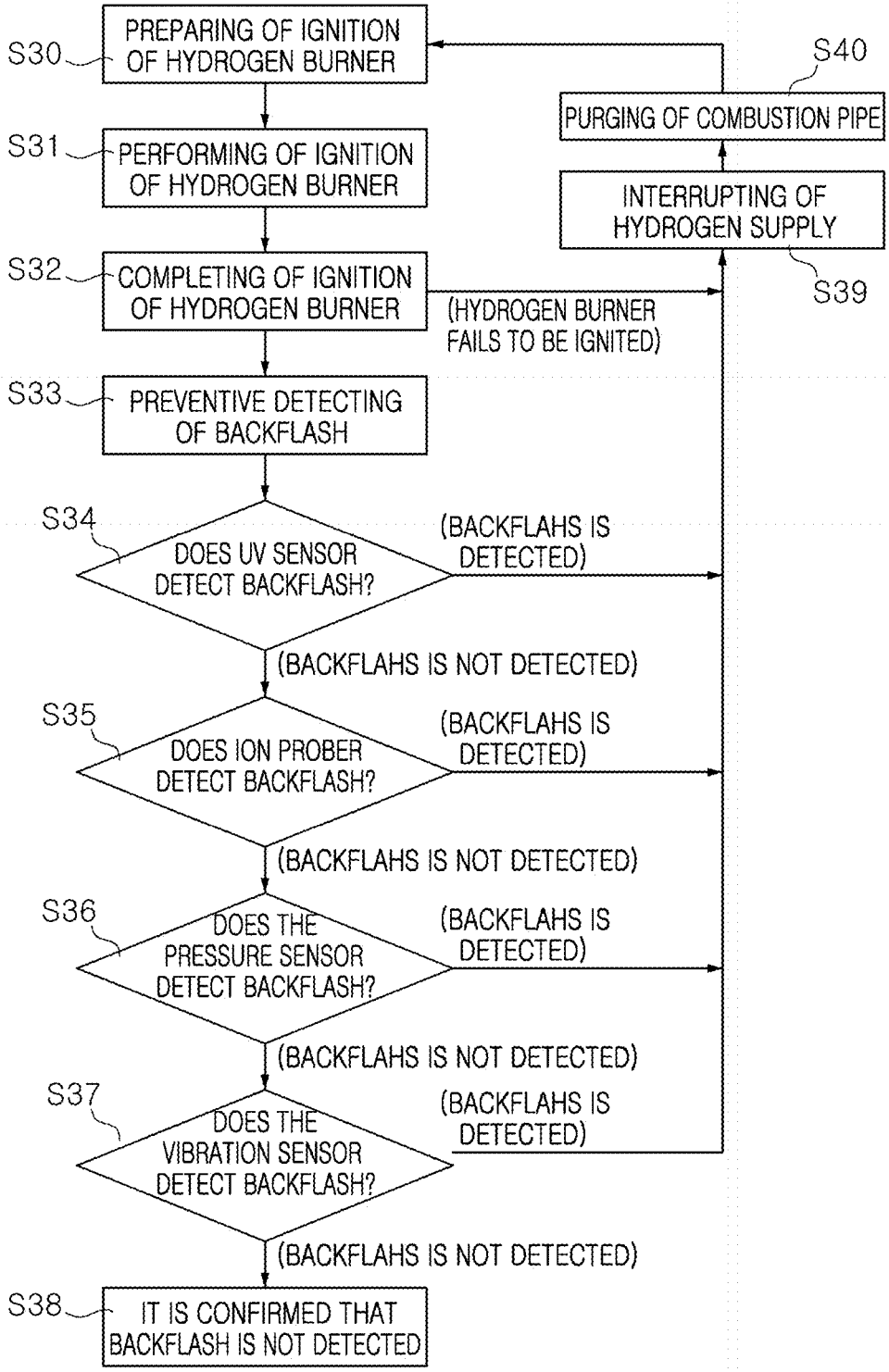
FIG. 7 is a flowchart for real-time detection of the backflash according to the various exemplary embodiments of the present disclosure.

FIG. 7 is a flowchart for real-time detection of the backflash according to the various exemplary embodiments of the present disclosure.

A step S30 of preparing ignition of the hydrogen burner 100, a step S31 of performing the ignition of the hydrogen burner 100, and a step S32 of completing the ignition of the hydrogen burner 100 may be performed in a time series in the same manner as the step S10 of preparing ignition of the hydrogen burner 100, the burner ignition step, the step S11 of performing the ignition of the hydrogen burner 100, and step S12 of completing the ignition of the hydrogen burner 100.

Furthermore, when the hydrogen burner 100 fails to be ignited in the step S32 of completing the ignition of the hydrogen burner 100, a step S39 of interrupting hydrogen supply, a step S40 of purging the combustion pipe, and the step S30 of preparing ignition of the hydrogen burner 100 may be performed in a time series in the same manner as the step S18 of interrupting hydrogen supply, the step S19 of purging the combustion pipe, and the step S10 of preparing ignition of the hydrogen burner 100 that are described above.

In a step S33 of preventively detecting the backflash, the backflash detection unit is configured to re-determine whether or not the backflash occurs. In the step S33 of preventively detecting the backflash, a step S34 in which the UV sensor is configured to perform detecting, a step S35 in which the backflash-detection ion prober 530 is configured to perform detecting, a step S36 in which the backflash-detection pressure sensor 510 is configured to perform detecting, and a step S37 in which the backflash-detection vibration sensor 520 is configured to perform detecting may be sequentially performed.

In an exemplary embodiment of the present disclosure, the order of S34, S35, S36, and S37 may not necessarily be in sequence.

When an abnormality is detected in any one of the step S34 in which the UV sensor performs detecting, the step S35 in which the backflash-detection ion prober 530 performs detecting, the step S36 in which the backflash-detection pressure sensor 510 performs detecting, and the step S37 in which the backflash-detection vibration sensor 520 performs detecting, a step S39 of interrupting hydrogen supply, a step S40 of purging the combustion pipe, and the step S30 of preparing ignition of the hydrogen burner 100 may be performed.

A step S38 of checking that the backflash is not detected may be performed when an abnormality is not detected in any one of the step S34 in which the UV sensor performs detecting, the step S35 in which the backflash-detection ion prober 530 performs detecting, the step S36 in which the backflash-detection pressure sensor 510 performs detecting, the step S37 in which the backflash-detection vibration sensor 520 performs detecting. Accordingly, a monitoring may be performed in real time in the same manner as when the backflash is preventively detected.

The backflash-detection vibration sensor 520 may be provided on the surface of the external casing of the hydrogen burner 100. The backflash-detection pressure sensor 510 may be provided on the hydrogen supply flow-path tube 111, and more specifically, connected to the hydrogen supply flow-path tube 111 in a state of being positioned in front of the backflash-detection vibration sensor 520.

A plurality of backflash-detection ion probers 530 may be provided to be spaced a predetermined distance apart along a longitudinal direction of the second pipe 130. The backflash detection and spark detection sensor 540 may be provided to face toward an end portion of the combustion nozzle end portion 141.

Figure 8:
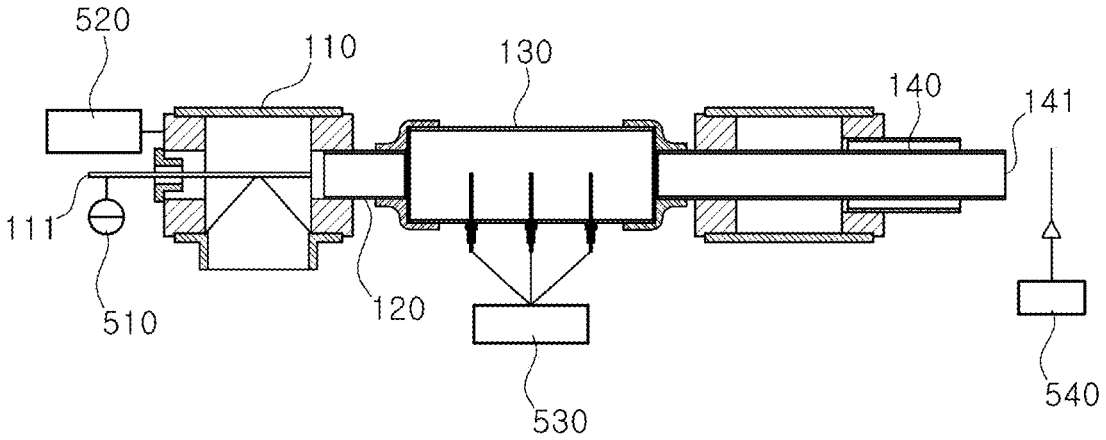
FIG. 8 is a vertical cross-sectional view exemplarily illustrating a backflash detection unit of the hydrogen burner according to the various exemplary embodiments of the present disclosure.
Figure 9:
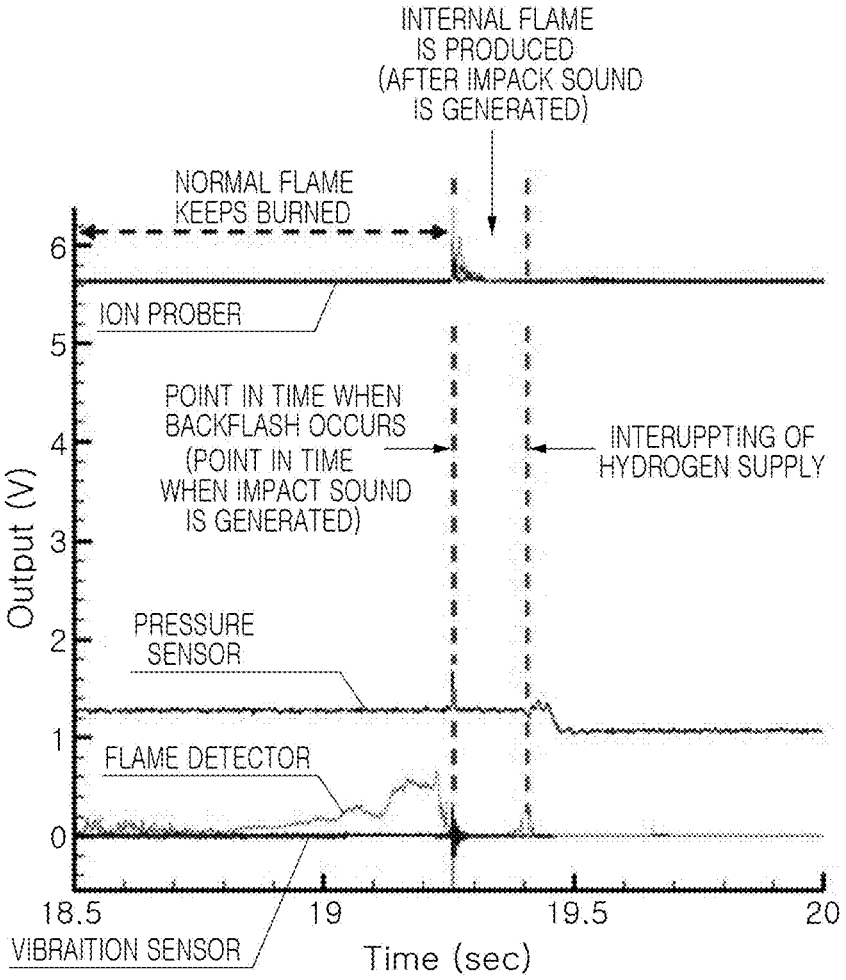
FIG. 9 is a graph showing integrated data relating to detection of the occurrence of the backflash according to the various exemplary embodiments of the present disclosure.

FIG. 8 is a view exemplarily illustrating the backflash detection unit of the hydrogen burner 100 according to the various exemplary embodiments of the present disclosure. FIG. 9 is a graph showing integrated data relating to detection of the occurrence of the backflash according to the various exemplary embodiments of the present disclosure. As shown in FIG. 9, each of the backflash detection units may detect a signal indicating the occurrence of an abnormality, and the control unit 200 may detect the occurrence of the backflash based on the signal.

Figure 10A:
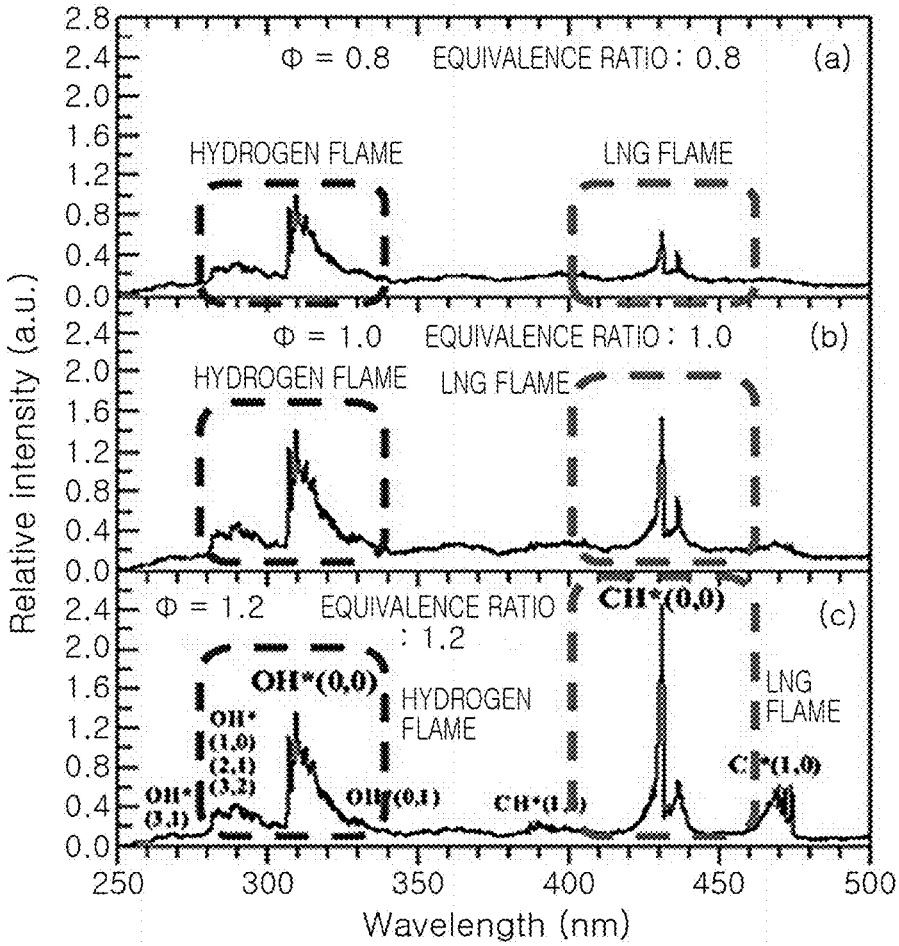
FIG. 10A is a graph showing wavelength ranges of a hydrogen flame and an LNG (methane) flame that vary with the equivalence ratio according to the various exemplary embodiments of the present disclosure.
Figure 10B:
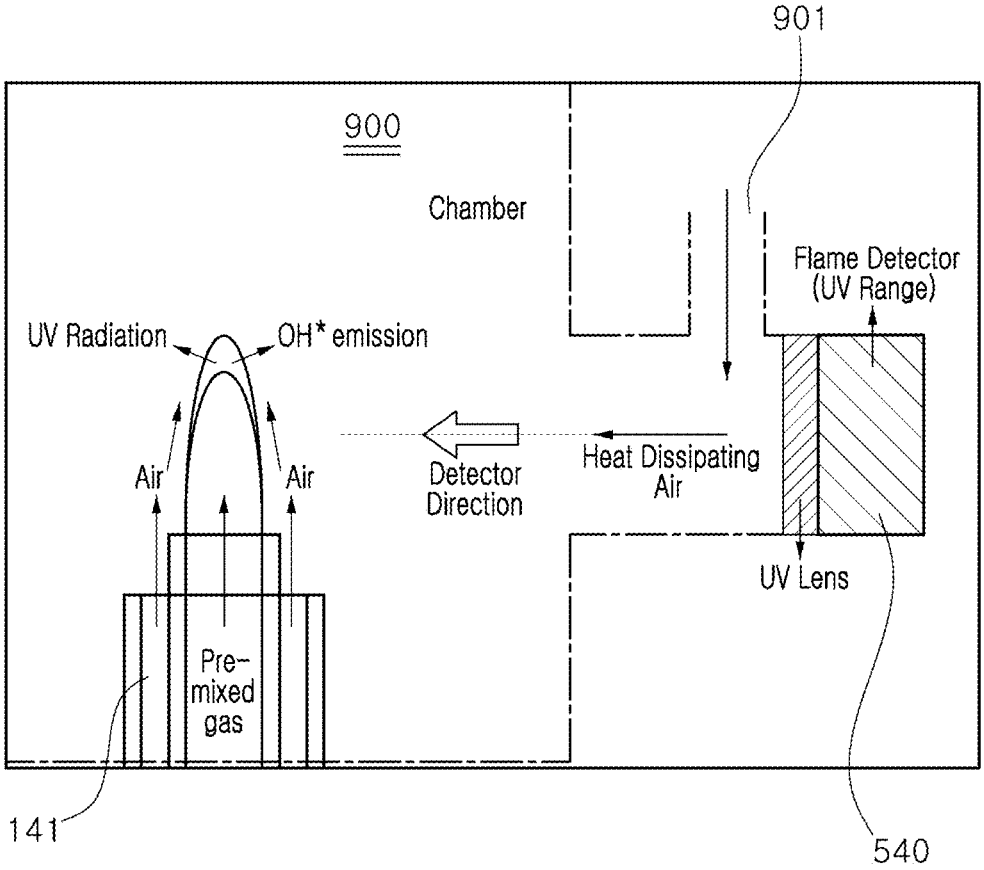
FIG. 10B is a view exemplarily illustrating a configuration of a UV sensor.
Figure 10C:
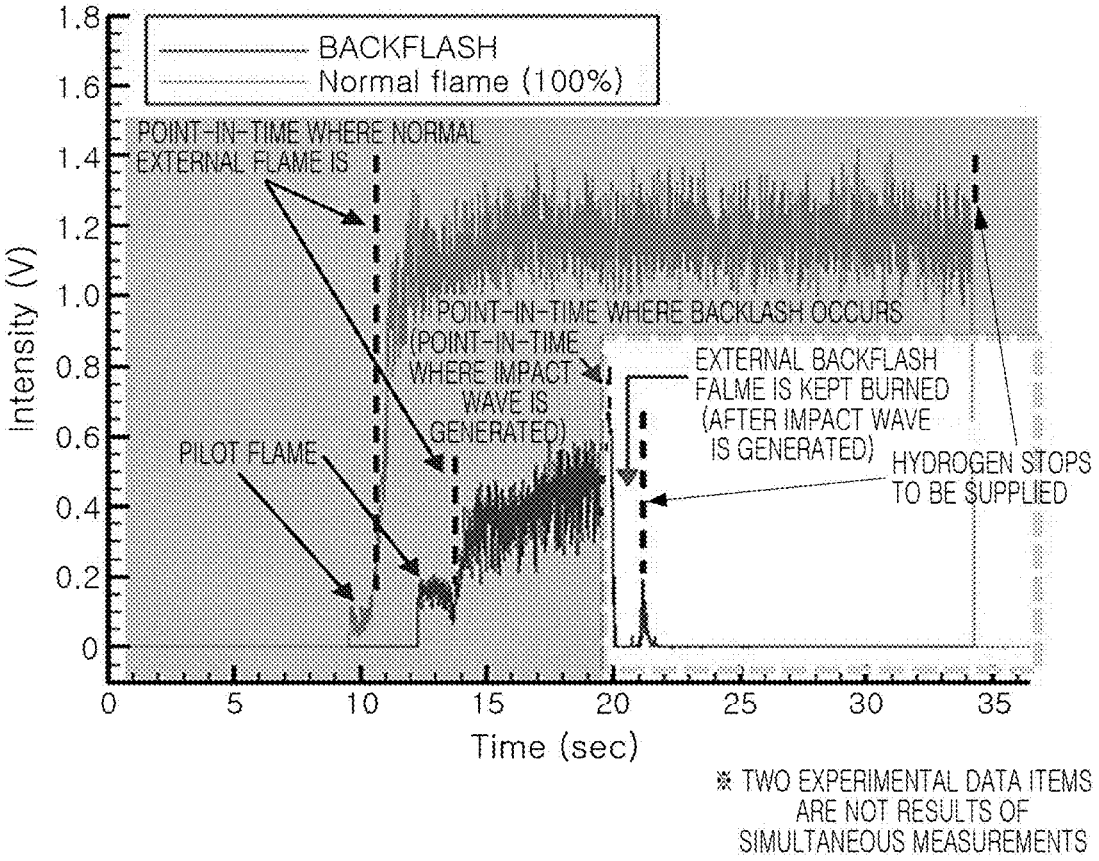
FIG. 10C is a graph showing results of an experiment with a normal flame and the backflash for comparison.

FIG. 10A is a graph showing wavelength ranges of a hydrogen flame and an LNG (methane) flame that vary with the equivalence ratio according to the various exemplary embodiments of the present disclosure. FIG. 10B is a view exemplarily illustrating a configuration of the UV sensor. FIG. 10C is a graph showing results of an experiment with a normal flame and the backflash for comparison.

The backflash detection and spark detection sensor 540 may be positioned so that faces the combustion nozzle end portion 141 inside the combustion chamber 900. Air 901 for dissipating heat may be provided to protect the backflash detection and spark detection sensor 540 from heat generated from the combustion nozzle end portion 141. That is, air 901 for dissipating heat may flow into the combustion chamber 900 along the lateral direction thereof. Thus, the flame and the heat may be prevented from propagating from the orifice of the combustion nozzle end portion 141 toward the backflash detection and spark detection sensor 540. At the same time, the backflash detection and spark detection sensor 540 may be effectively cooled.

FIG. 10A shows data for comparing the wavelength ranges of the LNG (methane) and the hydrogen flame that vary with the equivalence ratio. From FIG. 10A, it may be seen that an OH radical including a wavelength of 310 nm of an infrared region that occurs when the hydrogen flame occurs is generated, and that the backflash detection and spark detection sensor 540 can detect the OH radical.

When the backflash occurs, a flame may propagate into the combustion pipe, and thus the UV detect does not detect the flame. Accordingly, the control unit 200 may be configured to determine that the backflash occurs.

As illustrated in FIG. 10C, when the flame due to the occurrence of the backflash in the hydrogen burner 100 propagates into the hydrogen burner 100, the backflash-detection ion prober 530 may be configured to generate an electrical signal due to the conductivity of the flame.

Figure 11A:
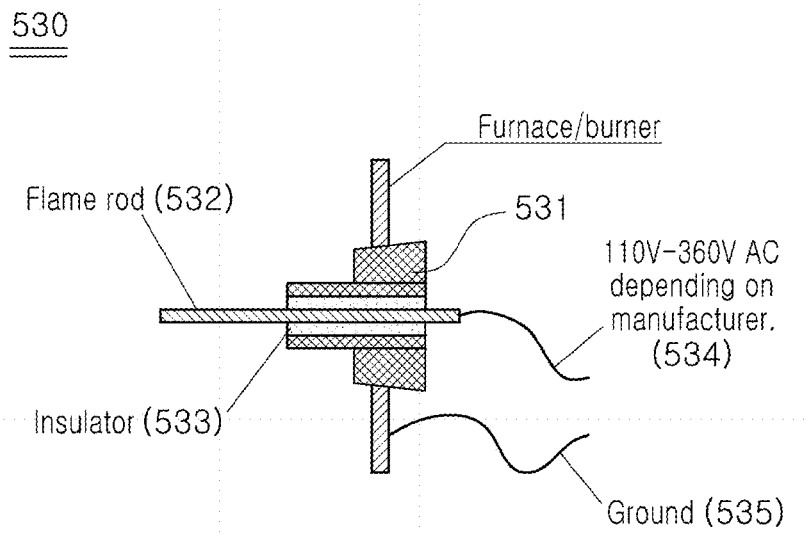
FIG. 11A and FIG. 11B are a cross-sectional view and an exploded view, respectively, that illustrate a backflash-detection ion prober according to the various exemplary embodiments of the present disclosure.
Figure 11B:
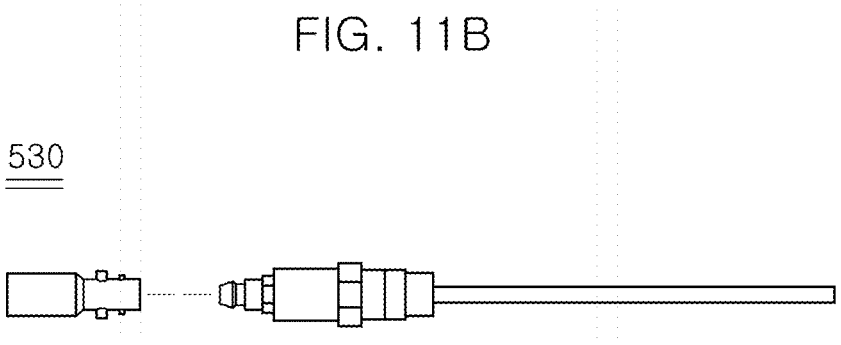
Figure 11C:
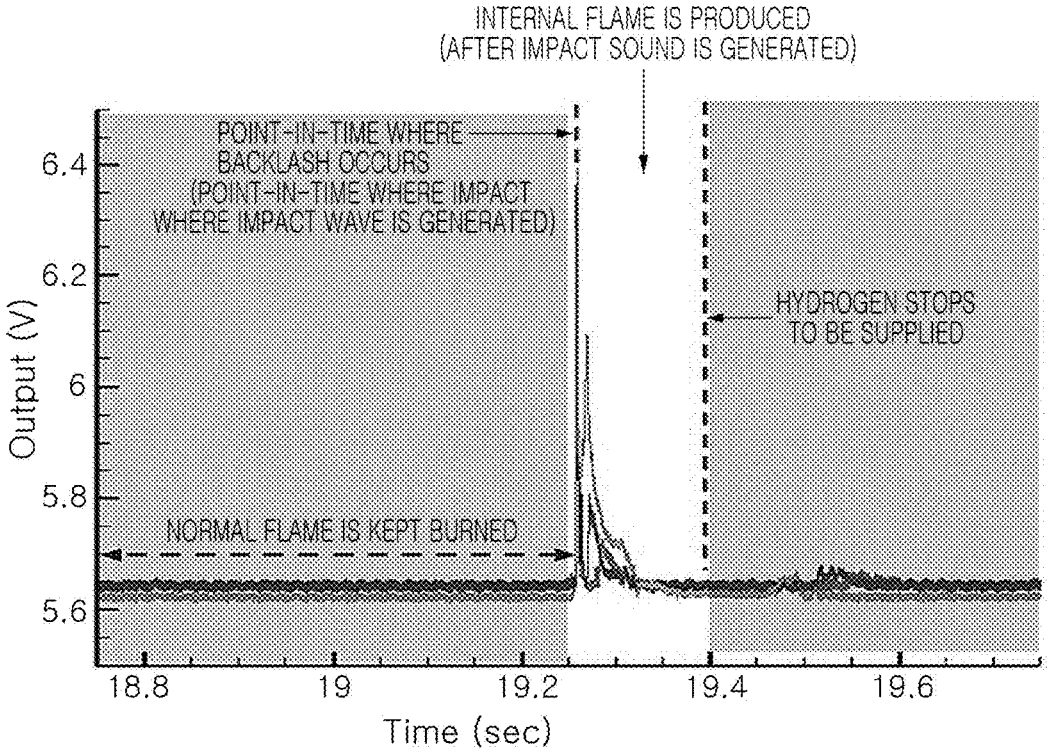
FIG. 11C is a graph showing data relating to the detection of the backflash by the backflash-detection ion prober.
Figure 12:
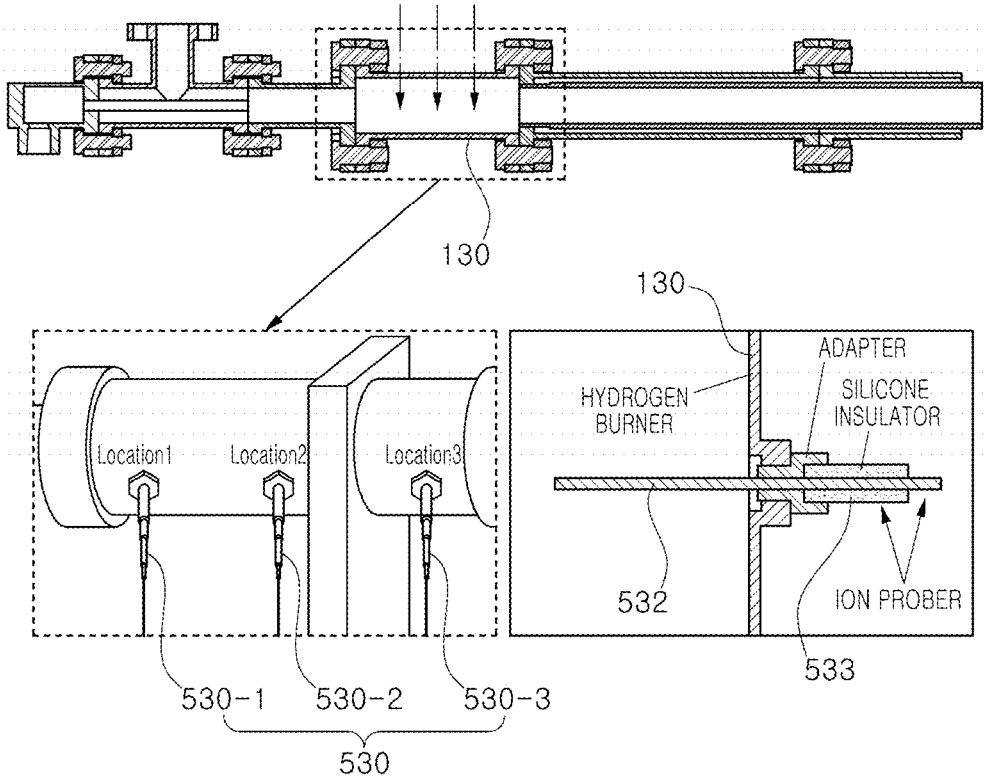
FIG. 12 is an enlarged view exemplarily illustrating a second pipe associated with installation of the backflash-detection ion prober according to the various exemplary embodiments of the present disclosure.

FIG. 11A and FIG. 11B are views each illustrating the backflash-detection ion prober 530 according to the various exemplary embodiments of the present disclosure. FIG. 11C is a graph showing data relating to the detection of the backflash by the backflash-detection ion prober 530. FIG. 12 is an enlarged view exemplarily illustrating the second pipe 130 according to the various exemplary embodiments of the present disclosure.

Two or more backflash-detection ion probers 530 may be provided considering the propagation of the flame and a position of the flame remaining stationary inside the combustion pipe, securing the reliability of detection. In the instant case, when the backflash occurs, as illustrated in FIGS. 9A and 11B, an output value of the backflash-detection ion prober 530 may be rapidly increased. Accordingly, the control unit 200 is configured to determine that the backflash occurs.

As illustrated in FIG. 11A, the backflash-detection ion prober 530 may include an adapter 531, a flame rod 532, an insulator 533, an electric connector 534 connected to a power source with 110V-360V AC, and a ground connector 535. FIG. 11B illustrates an external appearance of the backflash-detection ion prober 530. Three backflash-detection ion probers, that is, a first backflash-detection ion prober 530-1, a second backflash-detection ion prober 530-2, and a third backflash-detection ion prober 530-3, that form the backflash-detection ion prober 530 may be provided on the second pipe 130 to be spaced an equal distance apart as shown in FIG. 12.

Figure 13:
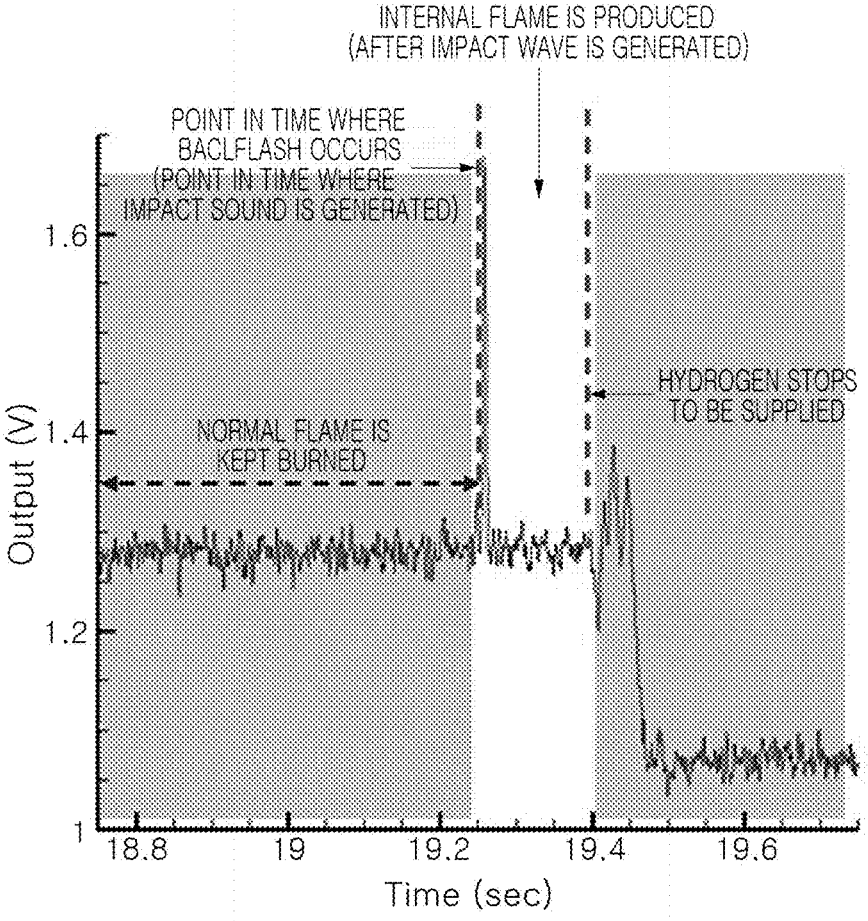
FIG. 13 is a graph showing data relating to the detection of the occurrence of the backflash by a pressure sensor according to the various exemplary embodiments of the present disclosure.
Figure 14:
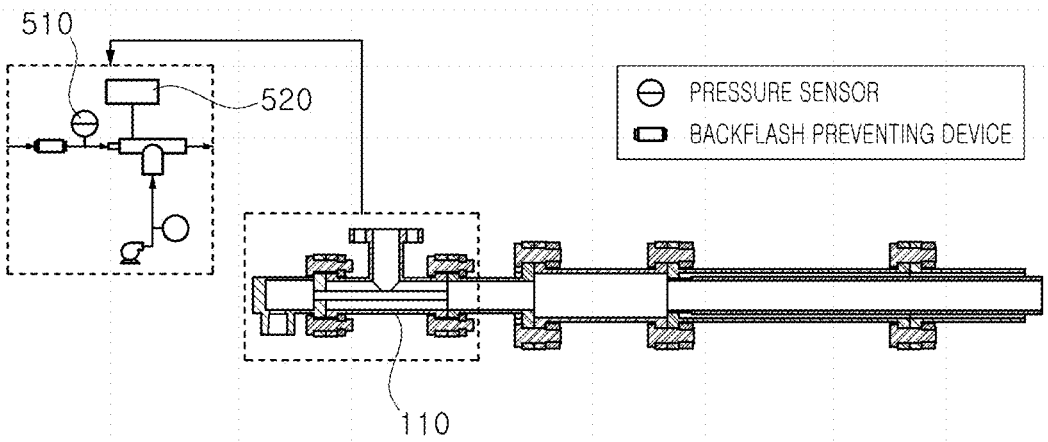
FIG. 14 is a view exemplarily illustrating that a backflash-detection pressure sensor and a backflash-detection vibration sensor according to the various exemplary embodiments of the present disclosure are provided.

FIG. 13 is a graph showing data relating to the detection of the occurrence of the backflash by the backflash-detection pressure sensor 510 according to the various exemplary embodiments of the present disclosure. FIG. 14 is a view exemplarily illustrating that the backflash-detection pressure sensor 510 and the backflash-detection vibration sensor 520 according to the various exemplary embodiments of the present disclosure are provided.

The backflash occurs due to an increase in pressure due to a spark inside the combustion pipe or the like. When the backflash occurs, pressure inside the combustion pipe changes, and thus the pressure for supplying hydrogen changes. The backflash-detection pressure sensor 510 may detect the change in the pressure for supplying hydrogen and thus may detect the backflash.

Figure 15:
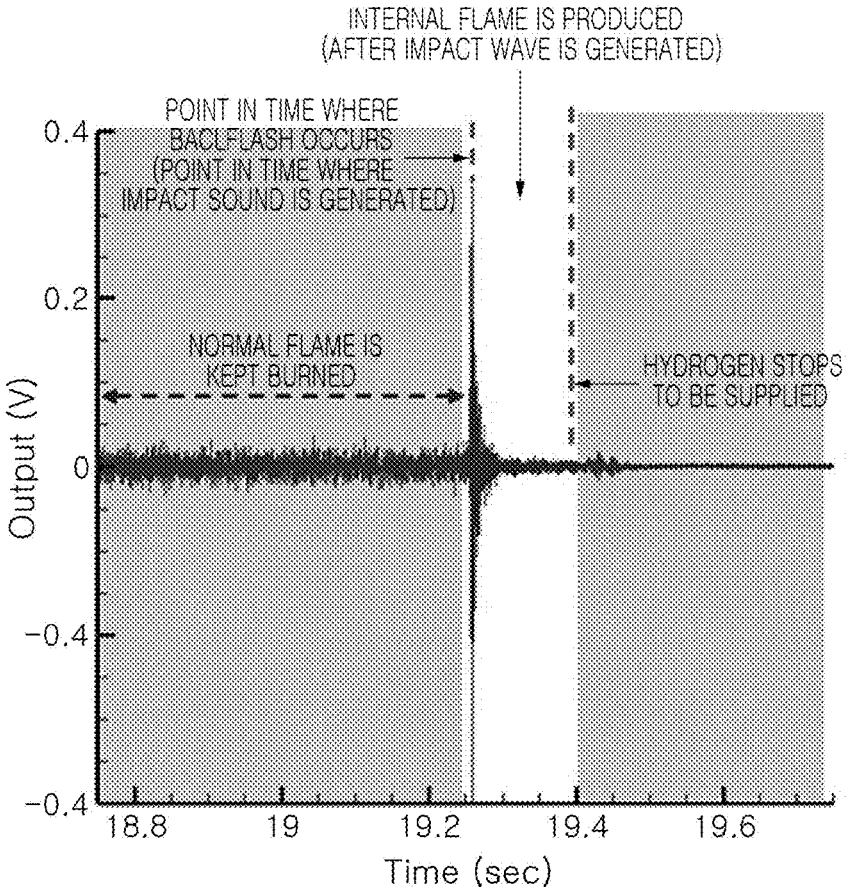
FIG. 15 is a graph showing data relating to the detection of the occurrence of the backflash by the backflash-detection vibration sensor according to the various exemplary embodiments of the present disclosure.

FIG. 15 is a graph showing data relating to the detection of the occurrence of the backflash by the backflash-detection vibration sensor 520 according to the various exemplary embodiments of the present disclosure. The backflash-detection vibration sensor 520 may be an acceleration sensor. The backflash-detection vibration sensor 520 may detect vibration due to the impact wave which is generated when the backflash occurs. When a magnitude of the vibration is at or above a reference value, the control unit 200 may be configured to determine the signal indicating the occurrence of an abnormality and thus may be configured to determine the occurrence of the backflash.

A flow for the control of the load on the hydrogen burner 100 according to the various exemplary embodiments of the present disclosure is described.

Figure 16:
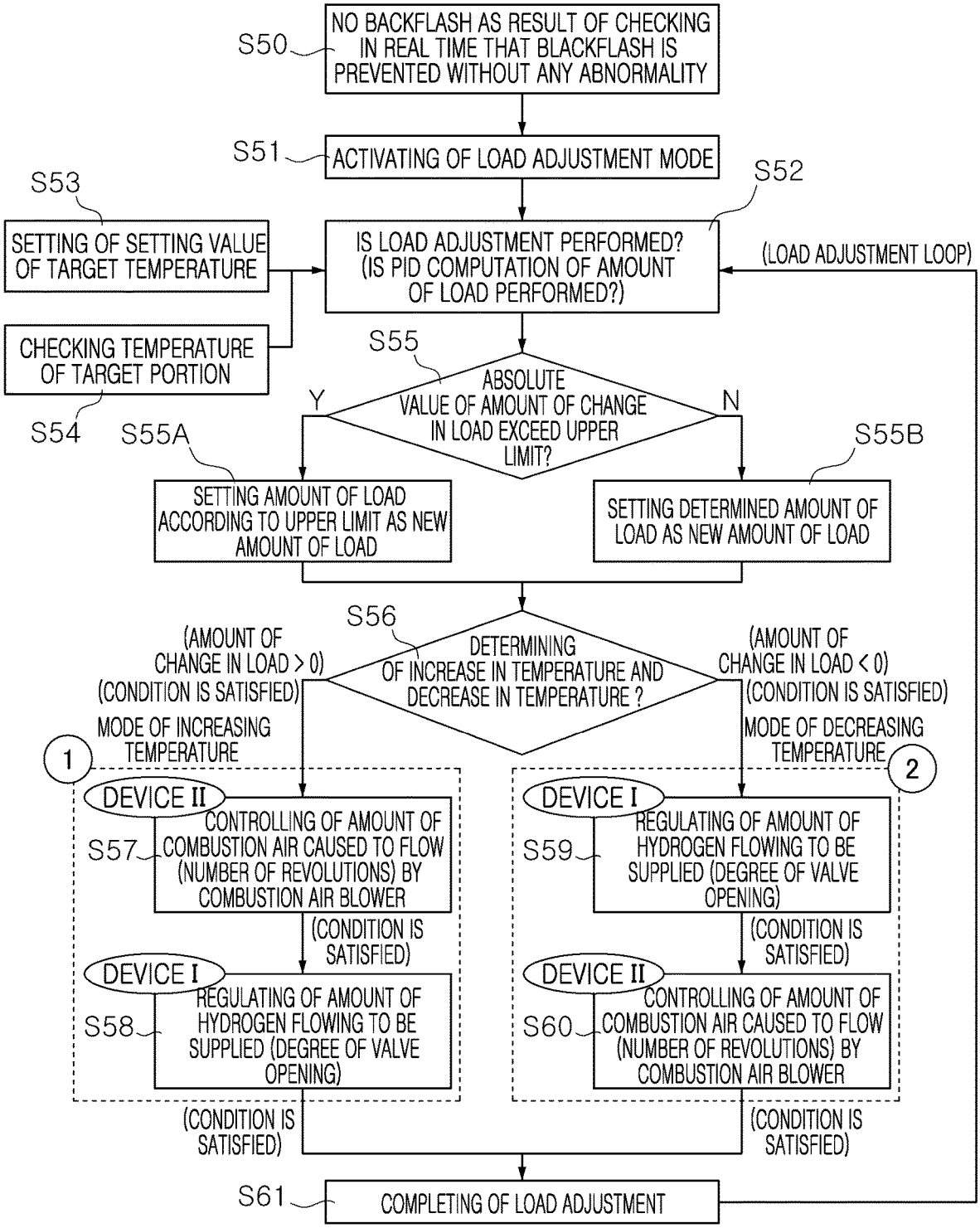
FIG. 16 is a flowchart for control of a load on the hydrogen burner according to the various exemplary embodiments of the present disclosure.
Figure 17:
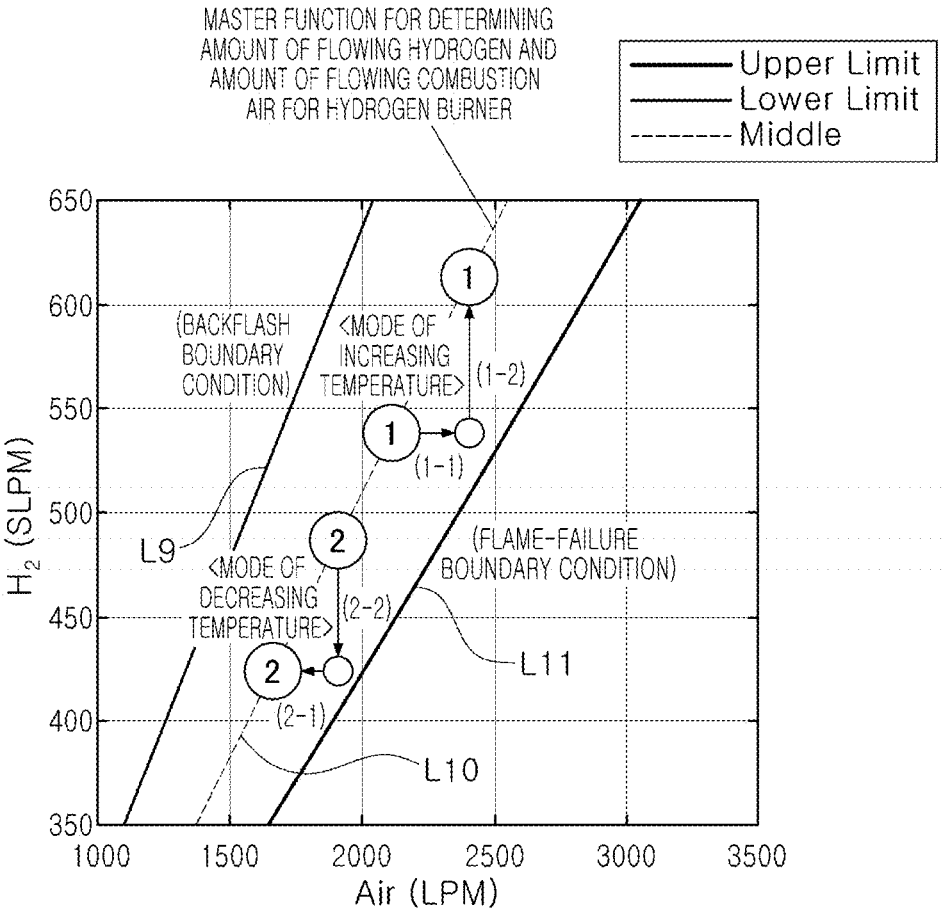
FIG. 17 is a graph showing a detailed control path and state change based on the control of the load on a combustion map according to the various exemplary embodiments of the present disclosure.
Figure 18:
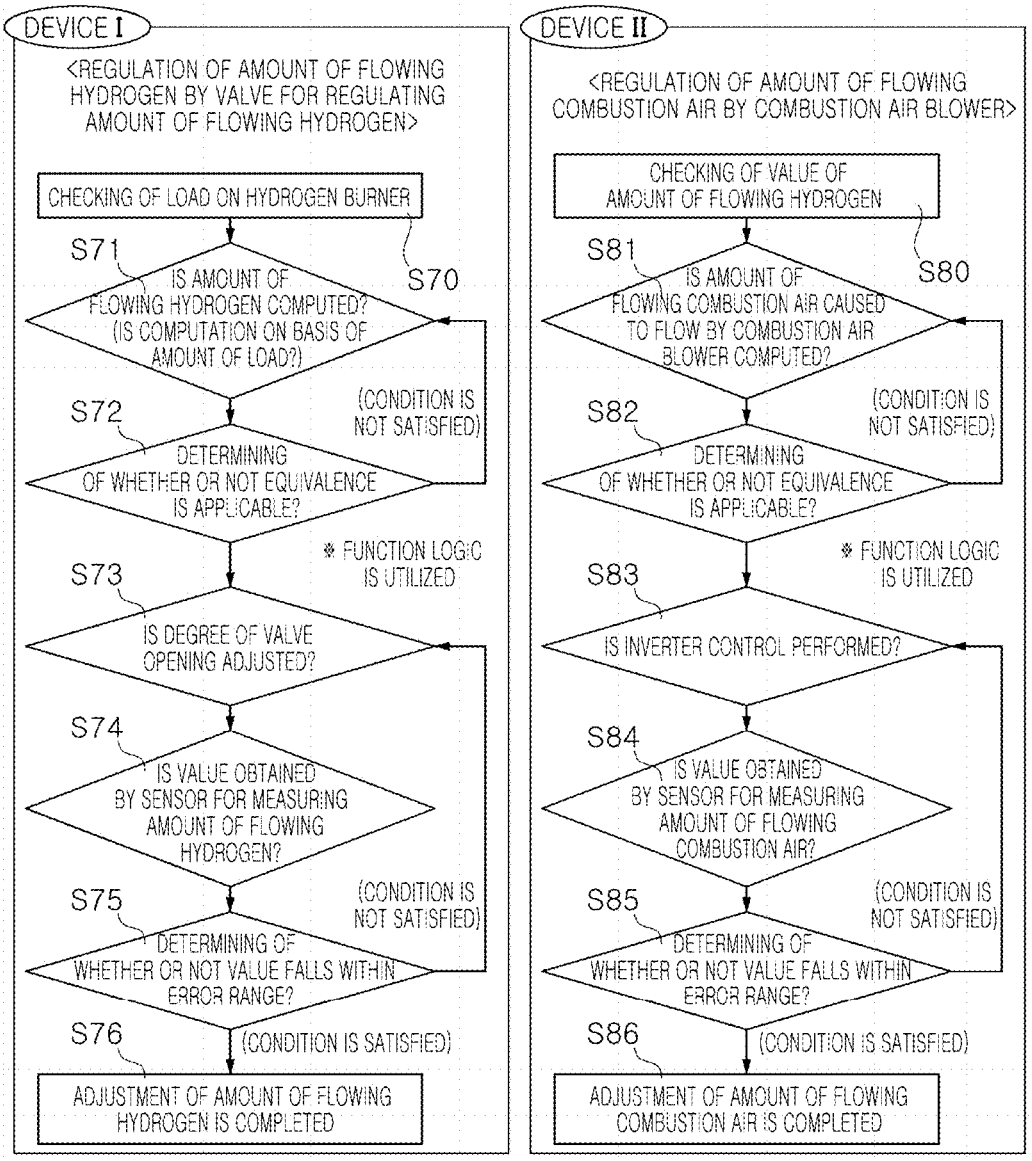
FIG. 18 is a flowchart illustrating regulation of an amount of flowing hydrogen and control of a load on a combustion air blower according to the various exemplary embodiments of the present disclosure.

FIG. 16 is a flowchart for the control of the load on the hydrogen burner 100 according to the various exemplary embodiments of the present disclosure. FIG. 17 is a graph showing a detailed control path and state change based on the control of the load on a combustion map according to the various exemplary embodiments of the present disclosure. FIG. 18 is a flowchart illustrating regulation of the amount of flowing hydrogen and control of a load on the combustion air blower 400 according to the various exemplary embodiments of the present disclosure.

Figure 4:
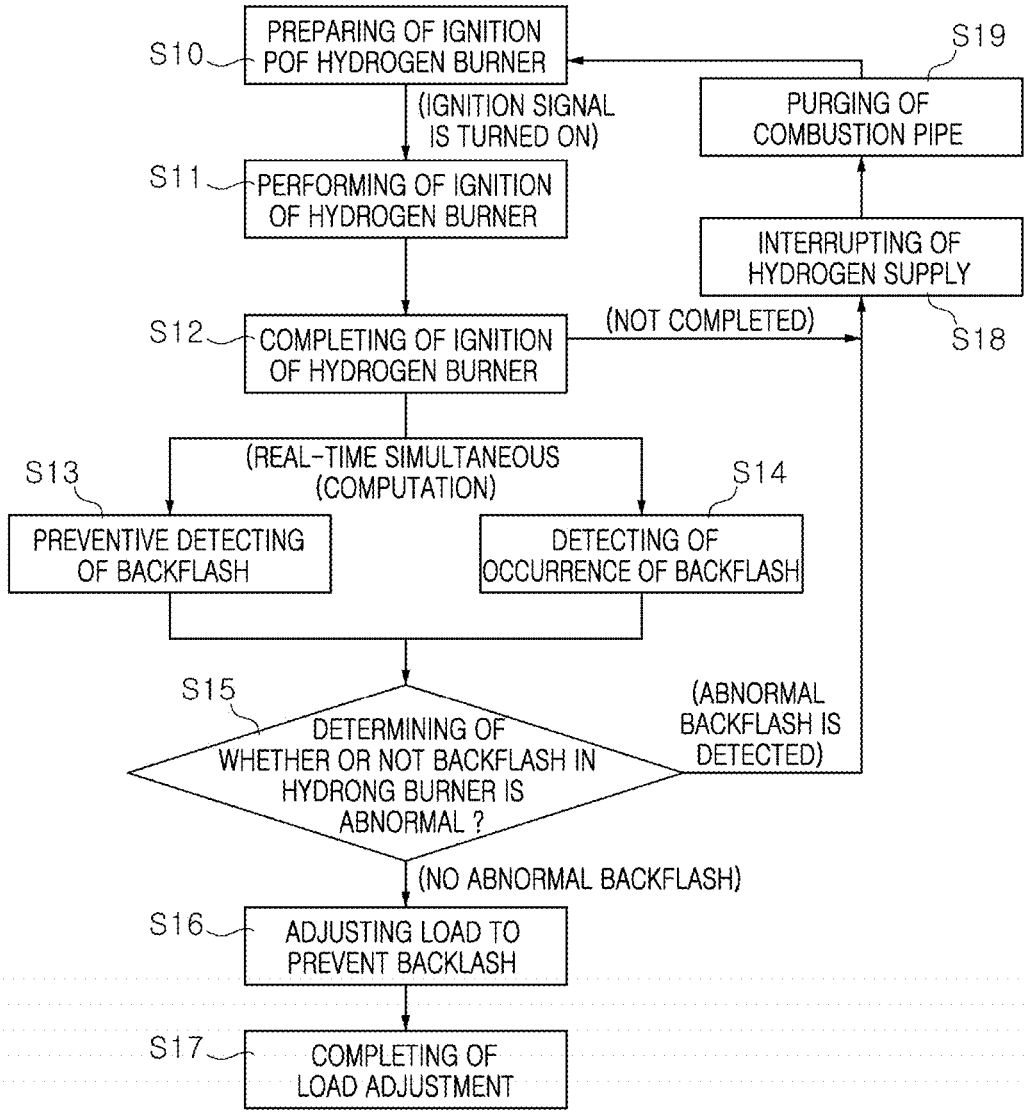
FIG. 4 is a flowchart which is referred to for description of a method of a preventive control and detection of the backflash according to the exemplary embodiment of the present disclosure.

The control of the load on the hydrogen burner 100 according to the various exemplary embodiments of the present disclosure corresponds to the step S16 of adjusting a load to prevent the backflash in FIG. 4. In other words, the control of the load on the hydrogen burner 100 according to the various exemplary embodiments of the present disclosure corresponds to the above-described second control.

The second control may be a control that makes it impossible to reach the condition for possibility for occurrence of backflash or a condition for possible occurrence of a flame failure. In the second control, a temperature measured at a predetermined target point in the hydrogen burner 100 may be compared with a predetermined temperature value, and an amount of load on the hydrogen burner 100 may be determined through loop control. When it is determined, in a step S50 of checking in real time that the backflash is prevented without any abnormality, that the backflash is normally prevented, a step S51 of activating a load adjustment mode may be performed.

Next, in a step S52 of performing load adjustment (determining an amount (PID) of load), the amount of load may be determined through a step S53 of setting a setting value of a target temperature and a step S54 of checking a temperature of a target portion. At the present point, the load adjustment may be performed using an upper limit of an absolute value of an amount of change in load. Here, the amount of change in load means a difference between a determined amount of load and an existing amount of load which is actually adjusted in a previous cycle when a first-time loop control is performed. An upper limit of the absolute value of the amount of change in load is set at a ratio (%) of the existing amount of load. When the absolute value of the amount of change in load exceeds a predetermined upper limit, the load adjustment may be performed according to the upper limit. That is, a step S55 of adjusting an upper limit of an amount of change in load to determine whether the absolute value of the amount of change in load is greater than the upper limit may be performed. Here, the absolute value of the amount of change in load means an absolute value which is determined by subtracting the existing amount of load from the determined amount of load.

Therefore, in a case where the absolute value of the amount of change in load exceeds the predetermined upper limit, the load adjustment may be performed by setting the amount of load according to the upper limit as a new amount of load (S55A). However, in a case where the absolute value of the amount of change in load does not exceed the predetermined upper limit, the load adjustment may be performed by setting the determined amount of load as a new amount of load (S55B). The reason of this is because the condition for possibility for occurrence of backflash or the condition for possible occurrence of a flame failure is satisfied in a case where the amount of combustion air and the amount of hydrogen flowing to be supplied changes greatly.

Next, a step S56 of determining an increase in temperature and a decrease in temperature may be performed. That is, in the step S56 of determining an increase in temperature and a decrease in temperature, when the amount of change in load is greater than 0, a third control may be performed so that a step S57 of determining an amount of combustion air caused to flow and regulating an amount (the number of revolutions) of the controlled combustion air blower, may be performed earlier than a step S58 of determining an amount of hydrogen caused to flow and controlling the amount (the degree of valve opening) of the valve 302 for regulating an amount of hydrogen flowing to be supplied.

At the present point, the third control may mean a control in a mode of increasing temperature. In the mode of increasing temperature, to increase temperature, computation and control of the amount of flowing combustion air through the use of an amount of hydrogen to be supplied are performed earlier than control of the amount of hydrogen to be supplied through the use of the amount of hydrogen to be supplied.

Conversely, when the amount of change in load is smaller than 0, a fourth control may be performed so that a step S59 of determining an amount of hydrogen caused to flow and controlling amount (the degree of valve opening) of the valve 302 for regulating an amount of hydrogen flowing to be supplied, may be performed earlier than a step S60 of determining an amount of combustion air caused to flow and controlling an amount (the number of revolutions) of the controlled combustion air blower in the step S60. At the present point, the fourth control may mean control in a mode of decreasing temperature. In the mode of decreasing temperature, to decrease temperature, the control of the amount of hydrogen to be supplied through use of the amount of hydrogen to be supplied may be performed earlier than the computation and control of the amount of flowing combustion air through use of the amount of hydrogen to be supplied.

Next, the step S61 of completing the load adjustment may be performed, and may return to the step S52 of performing load adjustment (i.e., determining an amount (PID) of load) may take place, whereby a loop control may be performed.

The above-described loop control may be any one of control that performs the steps in the following order: the step S52 of performing load adjustment (determining an amount (PID) of load), the S53 of setting a setting value of a target temperature, the step S54 of checking a temperature of a target portion, the step S55 of adjusting an upper limit of an amount of change in a load rate, the step S56 of determining an increase in temperature and a decrease in temperature, the step S57 of regulating an amount of combustion air caused to flow (the number of revolutions) by the combustion air blower, the step S58 of regulating an amount of hydrogen caused to flow (the degree of valve opening) by the valve 302 for regulating an amount of hydrogen flowing to be supplied, the step S61 of completing the load adjustment, and the step S52 of performing load adjustment (determining an amount (PID) of load), and control that performs the steps in the following order: the step S52 of performing load adjustment (determining an amount (PID) of load), the S53 of setting a setting value of a target temperature, the step S54 of checking a temperature of a target portion, the step S55 of adjusting an upper limit of an amount of change in a load rate, the step S56 of determining an increase in temperature and a decrease in temperature, the step S59 of regulating an amount of hydrogen caused to flow (the degree of valve opening) by the valve 302 for regulating an amount of hydrogen flowing to be supplied, the step S60 of regulating an amount of combustion air caused to flow (the number of revolutions) by the combustion air blower, the step S61 of completing the load adjustment, and the step S52 of performing load adjustment (determining an amount (PID) of load). The number of times may indicate how multiple times the control repeats a cycle from the step S52 of performing load adjustment (determining of an amount (PID) of load) to the next step S52 of performing load adjustment (determining of an amount (PID) of load).

At the present time, as illustrated in FIG. 18, a step S70 of checking the load on the hydrogen burner 100 and then a step S71 of determining the amount of flowing hydrogen may be performed for the control of the amount of flowing hydrogen (S58 and S59).

Next, in a step S73 of determining whether or not the equivalence ratio may be applicable, when it is determined that the equivalence ratio is not applicable, returning to step S71 of determining the amount of flowing hydrogen takes place. When it is determined that the equivalence ratio is applicable, proceeding to a step S73 of adjusting the degree of valve opening takes place. Next, in the step S73 of adjusting the degree of valve opening, the degree of valve opening is adjusted. In a step S75 of determining whether or not a value obtained by the sensor 301 for detecting an amount of hydrogen flowing to be supplied may fall within an error range, when it is determined that the value obtained does not fall within the error range, returning to the step S73 of adjusting the degree of valve opening takes place. When it is determined that the value obtained falls within the error range, proceeding to a step S76 of completing the control of the amount of flowing hydrogen takes place.

As illustrated in FIG. 18, a step S80 of checking a value of the amount of flowing hydrogen and then a step S81 of determining the amount of combustion air caused to flow by the combustion air blower 400 may be performed for the control of the amount of flowing combustion air (S57 and S60). Next, in a step S82 of determining whether or not the equivalence ratio is applicable, when it is determined that the equivalence ratio is not applicable, returning to the step S81 of determining the amount of combustion air caused to flow by the combustion air blower 400 takes place. When it is determined that the equivalence ratio is applicable, proceeding to a step S83 of determining an inverter control takes place.

Next, a step S83 of determining an inverter control, a step S84 of determining a value of the amount of flowing combustion air which is obtained by the sensor 401 for detecting an amount of combustion air flowing to be supplied, and a step S85 of determining whether or not the value of the amount of flowing combustion air falls within an error range are sequentially performed. In the step S85 of determining whether or not the value of the amount of flowing combustion air falls within an error range, when it is determined that the value of the amount of flowing combustion air does not fall within the error range, returning to the step S83 of determining an inverter control takes place. When it is determined that the value of the amount of flowing combustion air falls within the error range, proceeding to a step S86 of completing the control of the amount of flowing combustion air takes place.

At the present point, it is determined to activate the mode of increasing temperature or the mode of decreasing temperature, and then the amount of hydrogen flowing to be supplied that varies with the load on the hydrogen burner 100 may be determined regardless of the order in which the amount of hydrogen gas and the amount of combustion air are regulated. The control for the order of operation in the mode of increasing temperature or the mode of decreasing temperature may be performed to avoid the backflash boundary condition as far as possible. The reason for this may be because the higher the above-described equivalence ratio, the higher a propagation speed of the flame. In a case where the propagation speed of the flame is higher than the flowing speed of combustion air, the backflash may occur easily.

Initially, an upper limit may be imposed on the amount of change in load. However, for stable operation, it is determined whether or not reference points (1-1) and (2-1) are present within an operation range of operations, and then the control may be performed in FIG. 17. When making a prior determination, a determination may be made according to the safety, warning, and risk range in the same manner as when performing preventive control. When the safety range is reached, the next step may be performed. Re-computation is performed in other than the safety range before the control of the amount of flowing hydrogen and the control of the amount of flowing combustion air may be performed.

To easily switch between operations for the control of the load, a function for determining the amount of flowing hydrogen and the amount of flowing combustion air may be set so that the backflash boundary condition is satisfied in a comparatively easy way. The backflash boundary condition and a flame-failure boundary condition are determined taking into consideration a safety ratio allowing for a boundary line and safety rates allowing for error rates of the sensor 401 for detecting an amount of combustion air flowing to be supplied and the sensor 301 for detecting an amount of hydrogen flowing to be supplied and for error rates of control units for regulating the amount of flowing hydrogen and the amount of flowing combustion air.

An alarm occurs in a case where it takes a predetermined time period or longer for a feedback signal indicating the completion of the control of change in load to arrive after a signal for starting the control of the load is transmitted.

Figure 19:
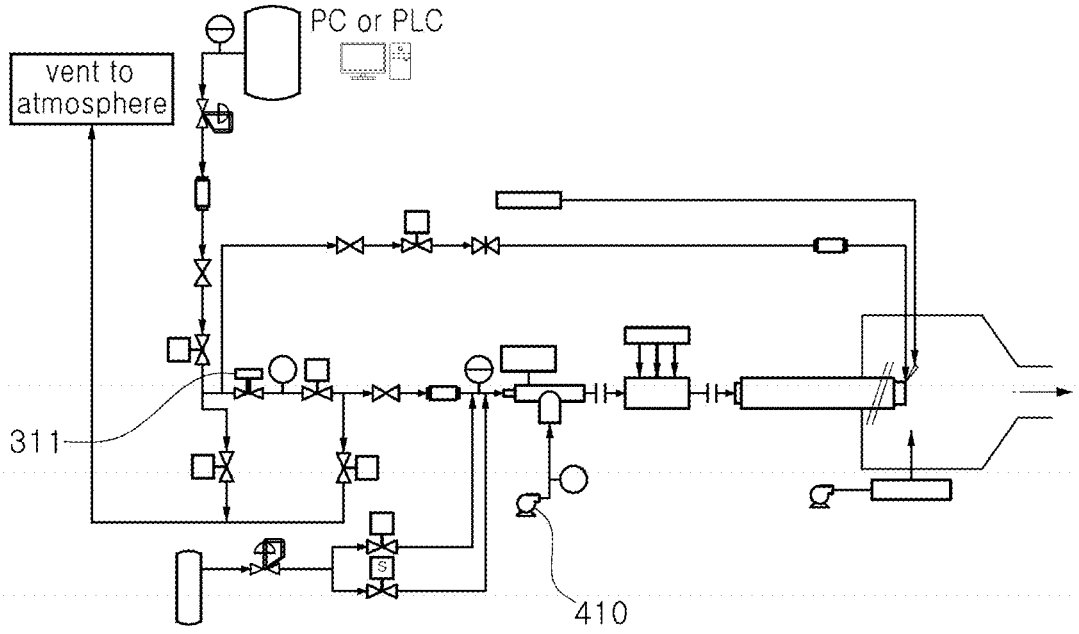
FIG. 19 is a view exemplarily illustrating a configuration of a system for preventing backflash in a pre-mixed hydrogen burner according to various exemplary embodiments of the present disclosure.

FIG. 19 is a view exemplarily illustrating a configuration of a system for preventing backflash in a pre-mixed hydrogen burner according to various exemplary embodiments of the present disclosure. As illustrated in FIG. 19, the value of the amount of flowing hydrogen to be supplied may be measured by a second device 311 configured for measuring an amount of flowing hydrogen to be supplied. In other words, the second device 311 configured for measuring an amount of flowing hydrogen to be supplied may be any one of a flowing-fluid speed sensor, a pressure sensor, and a mass sensor.

The amount of hydrogen flowing to be suppled may be regulated with a valve integrated with a sensor configured for measuring an amount of flowing fluid. The value of the amount of combustion air flowing to be supplied may be measured by a second device 410 configured for measuring an amount of combustion air flowing to be supplied.

The second device 410 configured for measuring an amount of combustion air flowing to be supplied may be one of a flowing-fluid speed sensor, a pressure sensor, and a mass sensor. The amount of combustion air flowing to be supplied is regulated by one of an inverter, a damper, and a brushless DC (BLDC) motor.

Figure 20:
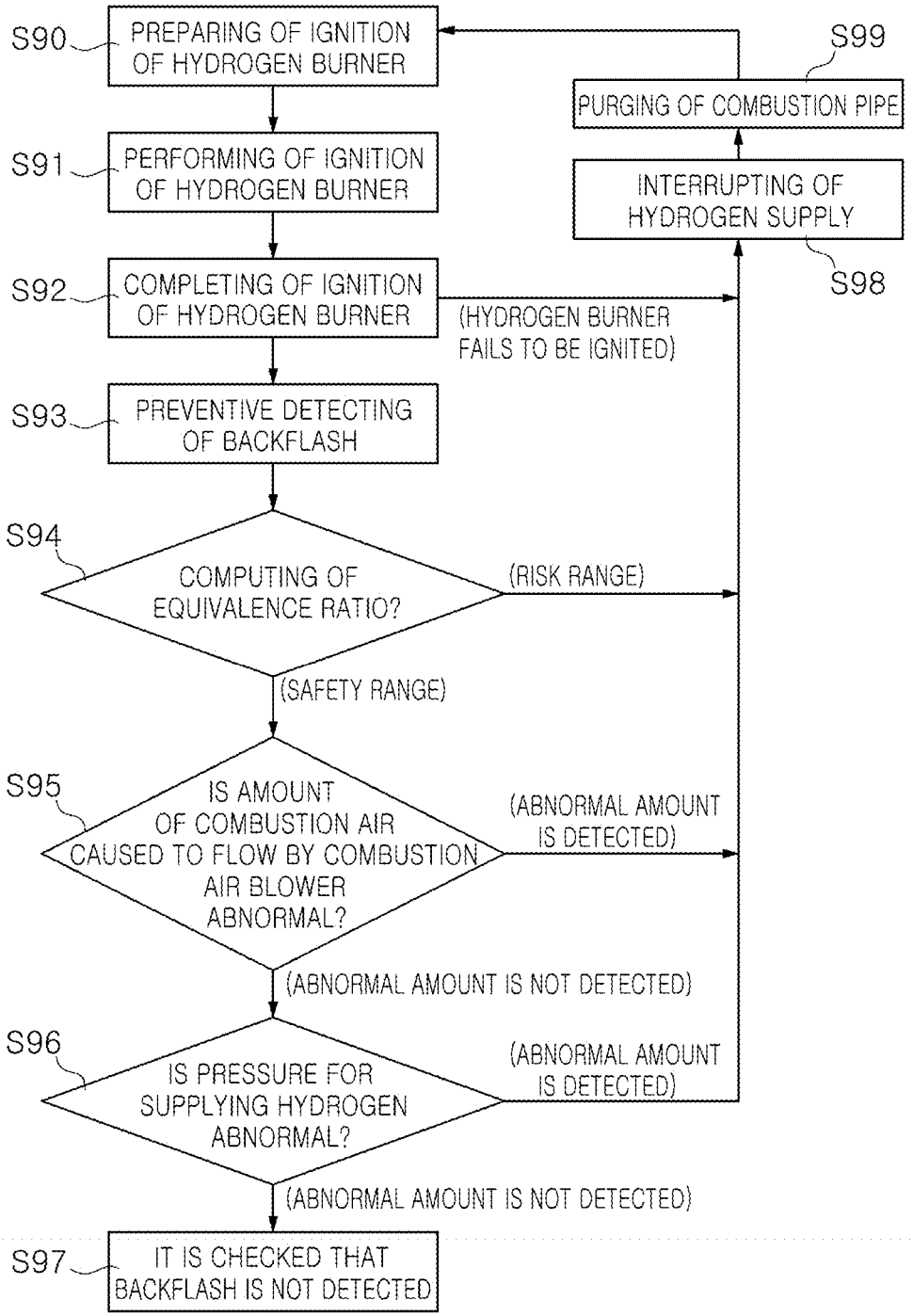
FIG. 20 is a flowchart for real-time preventive detection of the backflash according to the various exemplary embodiments of the present disclosure.

FIG. 20 is a flowchart for real-time preventive detection of the backflash according to the various exemplary embodiments of the present disclosure.

A step S90 of preparing ignition of the hydrogen burner 100, a step S91 of performing the ignition of the hydrogen burner 100, and a step S92 of completing the ignition of the hydrogen burner 100 may be in a time series in the same manner that the step S10 of preparing ignition of the hydrogen burner 100, the step S11 of performing the ignition of the hydrogen burner 100, and step S19 of purging the combustion pipe that are described above.

Furthermore, when the hydrogen burner 100 fails to be ignited in the step S92 of completing the ignition of the hydrogen burner 100, a step S98 of interrupting hydrogen supply, a step S99 of purging the combustion pipe, and the step S90 of preparing ignition of the hydrogen burner 100 may be performed in a time series in the same manner as the step S18 of interrupting hydrogen supply, the step S19 of purging the combustion pipe, and the step S10 of preparing ignition of the hydrogen burner 100 that are described above.

A step S93 of preventively detecting the backflash is performed in real time after the step S92 of completing the ignition of the hydrogen burner 100 may be performed. At the instant time, a step S94 of determining the equivalence ratio may be performed. At the instant time, in the step S94 of determining the equivalence ratio may be performed, the equivalence ratio is determined according to the above-described equation for determining the equivalence ratio, and the above-described backflash boundary condition may be determined.

When the backflash boundary condition corresponds to the risk range, the step S98 of interrupting hydrogen supply, the step S99 of purging the combustion pipe, and the step S90 of preparing ignition of the hydrogen burner 100 may be performed. When the backflash boundary condition corresponds to the safety range, a step S95 of determining whether or not the amount of combustion air caused to flow by the combustion air blower 400 is abnormal may be performed. Unlike in the above-described step S24 of determining the equivalence ratio in FIG. 6 which is described above, a logic for the real-time preventive detection of the backflash according to the various exemplary embodiments of the present disclosure may not include the warning range to which the backflash boundary condition corresponds.

In the step S95 of determining whether or not the amount of combustion air caused to flow by the combustion air blower 400, when it is detected that the amount of combustion air is abnormal, a step S98 of interrupting hydrogen supply, a step S99 of purging the combustion pipe, and the step S90 of preparing ignition of the hydrogen burner 100 may be performed.

In the step S95 of determining whether or not the amount of combustion air caused to flow by the combustion air blower 400, when it is not detected that the amount of combustion air is abnormal, that is, when the amount of combustion air is normal, a step S96 of determining whether or not pressure for supplying hydrogen is abnormal may be performed.

In the step S96 of determining whether or not pressure for supplying hydrogen is abnormal, when it is detected that the pressure for supplying hydrogen is abnormal, the step S98 of interrupting hydrogen supply, the step S99 of purging the combustion pipe and the step S90 of preparing ignition of the hydrogen burner 100 may be formed. In the step S96 of determining whether or not pressure for supplying hydrogen is abnormal, when it is not detected that the pressure for supplying hydrogen is abnormal, that is, when the pressure for supplying hydrogen is normal, a step S97 of checking that the backflash is not detected is performed, and then the process is ended.

As an implementation example of the present disclosure, a device configured for providing safety against a subsequent fire and a possible explosion accident after detecting backflash may be provided. Hydrogen is forced to be blocked from being continuously supplied by turning off a shut/off valve for supplying hydrogen.

Furthermore, residual gas between the shut/off valve for supplying hydrogen is discharged to the outside by turning on a solenoid value for hydrogen purge. Furthermore, an inert gas (for example, high-pressure nitrogen) for purge may be used to discharge residual hydrogen inside a rear end portion of the shut/off valve for supplying hydrogen and inside the combustion pipe. The combustion air blower 400 may supply fresh air, that is, outside air to discharge combustion gas inside the combustion pipe and the exhaust side of the combustion pipe. The combustion gas is discharged for at least 10 minutes after the backflash occurs and the combustion air blower 400 is then automatically turned off.

As an implementation example of the present disclosure, a check valve for preventing backflash may be included. Examples of the check valve may include a flame arrestor, a non-return valve, a pressure-sensitive cut-off valve, a temperature-sensitive cut-off valve, and an explosion pressure relief valve. The flame arrestor includes high-quality sintered stainless steel. The flame arrestor may prevent the backflash from propagating backward and is configured to automatically distinguish a fire.

The no-return valve may operate by a spring when the backflash occurs abruptly. The pressure sensitive cut-off valve may be automatically closed in a case where adverse pressure occurs due to the backflash or backward-propagation of a flame. The temperature sensitive cut-off valve may be automatically closed when temperature increases inside the temperature sensitive cut-off valve. To prevent an impact wave and soot due to the backflash, a vent spring valve may be mounted on the explosion pressure relief valve.

Furthermore, the term related to a control device such as "controller", "control apparatus", "control unit", "control device", "control module", or "server", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present disclosure. The control device according to exemplary embodiments of the present disclosure may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors. The processor may include various logic circuits and operation circuits, may be configured to process data according to a program provided from the memory, and may be configured to generate a control signal according to the processing result.

The control device may be at least one microprocessor operated by a predetermined program which may include a series of commands for carrying out the method included in the aforementioned various exemplary embodiments of the present disclosure.

The aforementioned invention can also be embodied as computer readable codes on a computer readable recording medium. The computer readable recording medium is any data storage device that can store data which may be thereafter read by a computer system and store and execute program instructions which may be thereafter read by a computer system. Examples of the computer readable recording medium include Hard Disk Drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet). Examples of the program instruction include machine language code such as those generated by a compiler, as well as high-level language code which may be executed by a computer using an interpreter or the like.

In various exemplary embodiments of the present disclosure, each operation described above may be performed by a control device, and the control device may be configured by a plurality of control devices, or an integrated single control device.

In various exemplary embodiments of the present disclosure, the memory and the processor may be provided as one chip, or provided as separate chips.

In various exemplary embodiments of the present disclosure, the scope of the present disclosure includes software or machine-executable commands (e.g., an operating system, an application, firmware, a program, etc.) for enabling operations according to the methods of various embodiments to be executed on an apparatus or a computer, a non-transitory computer-readable medium including such software or commands stored thereon and executable on the apparatus or the computer.

In various exemplary embodiments of the present disclosure, the control device may be implemented in a form of hardware or software, or may be implemented in a combination of hardware and software.

Furthermore, the terms such as "unit", "module", etc. included in the specification mean units for processing at least one function or operation, which may be implemented by hardware, software, or a combination thereof.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The term "and/or" may include a combination of a plurality of related listed items or any of a plurality of related listed items. For example, "A and/or B" includes all three cases such as "A", "B", and "A and B".

In the present specification, unless stated otherwise, a singular expression includes a plural expression unless the context clearly indicates otherwise.

In exemplary embodiments of the present disclosure, "at least one of A and B" may refer to "at least one of A or B" or "at least one of combinations of at least one of A and B". Furthermore, "one or more of A and B" may refer to "one or more of A or B" or "one or more of combinations of one or more of A and B".

In the exemplary embodiment of the present disclosure, it should be understood that a term such as "include" or "have" is directed to designate that the features, numbers, steps, operations, elements, parts, or combinations thereof described in the specification are present, and does not preclude the possibility of addition or presence of one or more other features, numbers, steps, operations, elements, parts, or combinations thereof.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described in order to explain certain principles of the invention and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. A system of preventing backflash in a pre-mixed hydrogen burner, the system comprising:

the hydrogen burner including a mixture pipe connected to a hydrogen supply flow-path tube along which hydrogen is guided and a combustion air supply flow-path tube along which combustion air is guided, wherein a mixture of the hydrogen and the combustion air is combusted at a combustion nozzle end portion of a pipe connected to the mixture pipe; and a control unit configured to perform a first control to purge the pipe and to interrupt supply of the hydrogen, in response that the backflash propagates or is likely to propagate from the combustion nozzle end portion to the mixture pipe during the combustion, and further configured to perform a second control that adjusts a load on the hydrogen burner, in response of determining that the backflash does not occur during the combustion or that the backflash is not likely to occur during the combustion.

2. A system of preventing backflash in a pre-mixed hydrogen burner, the system comprising:

the hydrogen burner including a mixture pipe connected to a hydrogen supply flow-path tube along which hydrogen is guided and a combustion air supply flow-path tube along which combustion air is guided, wherein a mixture of the hydrogen and the combustion air is combusted at a combustion nozzle end portion of a pipe connected to the mixture pipe; and a control unit configured for measuring in real time an amount of the hydrogen flowing to be supplied and an amount of the combustion air flowing to be supplied and compute an equivalence ratio of the combustion air to the hydrogen to detect in real time that the backflash is likely to propagate from the combustion nozzle end portion to the mixture pipe during the combustion, and to purge the pipe and to interrupt supply of the hydrogen, in response that the determined equivalence ratio satisfies a predetermined backflash boundary condition and thus the backflash is likely to propagate from the combustion nozzle end portion to the mixture pipe during the combustion.

3. A system of preventing backflash in a pre-mixed hydrogen burner, the system comprising:

the hydrogen burner including a mixture pipe connected to a hydrogen supply flow-path tube along which hydrogen is guided and a combustion air supply flow-path tube along which combustion air is guided, wherein a mixture of the hydrogen and the combustion air is combusted at a combustion nozzle end portion of a pipe connected to the mixture pipe;

a backflash-detection pressure sensor, a backflash-detection vibration sensor, a backflash-detection ion prober, and a backflash detection and spark detection sensor that are sequentially provided in a front and rear direction with respect to the pipe to detect in real time that the backflash propagates from the combustion nozzle end portion to the mixture pipe during the combustion; and a control unit configured to perform a first control to purge the pipe and to interrupt supply of the hydrogen in response of detecting that the backflash propagates from the combustion nozzle end portion to the mixture pipe.

4. The system of claim 3, wherein the backflash-detection pressure sensor is connected to the hydrogen supply flow-path tube.

5. The system of claim 3, wherein the backflash-detection vibration sensor is provided on a surface of an external casing of the hydrogen burner.

6. The system of claim 3, wherein the backflash-detection ion prober is provided on a second pipe that connects a first pipe including the combustion nozzle end portion and the mixture pipe to each other.

7. The system of claim 3, wherein the backflash detection and spark detection sensor is provided to face toward the combustion nozzle end portion.

8. The system of claim 7, wherein the backflash detection and spark detection sensor is a ultraviolet (UV) sensor, or an infrared sensor.

9. The system of claim 1, wherein an amount of the hydrogen flowing to be supplied is measured by at least one of first sensors including a flowing-fluid speed sensor, a pressure sensor, and a mass sensor and is regulated by a fluid control valve, and wherein an amount of the combustion air flowing to be supplied is measured by at least one of second sensors including a flowing-fluid speed sensor, a pressure sensor, and a mass sensor and is regulated by at least one of an inverter, a damper, and a brushless DC (BLDC) motor.

10. The system of claim 2, wherein according to a result of comparing the determined equivalence ratio with a reference rate, the backflash boundary condition is categorized as a safety range, a warning range, or a risk range.

11. The system of claim 10, wherein in the safety range, a result of the computation of the equivalence ratio is equal to or greater than 0% and smaller than 75%, compared against a predetermined reference safety ratio, wherein in the warning range, the result of the computation of the equivalence ratio is equal to or greater than 75% and smaller than 90%, compared against the predetermined reference safety ratio, and wherein in the risk range, the result of the computation of the equivalence ratio is equal to or greater than 90% and equal to or smaller than 100%, compared against the predetermined reference safety ratio.

12. The system of claim 11, wherein in response that the backflash boundary condition corresponds to the risk range, the control unit is configured to perform a first control to purge the pipe and to interrupt supply of the hydrogen in response of detecting that the backflash propagates from the combustion nozzle end portion to the mixture pipe.

13. A method of preventing the backflash in the pre-mixed hydrogen burner in the system of claim 2, the method including:

preparing, by the control unit, ignition of the hydrogen burner by supplying the hydrogen and the combustion air to the pipe;

performing, by the control unit, the ignition of the hydrogen burner;

completing, by the control unit, the ignition of the hydrogen burner, wherein a first control is performed in response that the hydrogen burner failing to ignite; and determining, by the control unit, an equivalence ratio in response that the hydrogen burner is ignited, wherein the backflash boundary condition is categorized as a safety range in which a result of the computation of the equivalence ratio is equal to or greater than 0% and smaller than 75%, compared against a predetermined reference safety ratio, a warning range in which the result of the computation of the equivalence ratio is equal to or greater than 75% and smaller than 90%, compared against the predetermined reference safety ratio, and a risk range in which the result of the computation of the equivalence ratio is equal to or greater than 90% and equal to or smaller than 100%, compared against the predetermined reference safety ratio, and wherein in response that the backflash boundary condition corresponds to the warning range, the amount of the hydrogen flowing to be supplied and the amount of the combustion air flowing to be supplied, which are supplied at the previous equivalence ratio, are forced to be regulated, and then a new equivalence ratio is determined.

14. The method of claim 13, wherein in response that the backflash boundary condition corresponds to the risk range, the first control to purge the pipe and to interrupt supply of the hydrogen in response of detecting that the backflash propagates from the combustion nozzle end portion to the mixture pipe is performed.

15. The method of claim 14, further including:

determining, by the control unit, whether or not a combustion air blower operates abnormally, wherein the first control is performed in the determining of whether or not a combustion air blower operates abnormally in response that the backflash boundary condition corresponds to the safety range and that the amount of the combustion air flowing to be supplied is at or below a predetermined value; and determining, by the control unit, whether or not pressure for supplying the hydrogen is abnormal, wherein the first control is performed in the determining of whether or not pressure for supplying the hydrogen is abnormal in response that the combustion air blower operates normally and in response of determining that the pressure for supplying the hydrogen exceeds a predetermined upper limit of a permissible range.

16. The method of claim 15, wherein the pressure for supplying the hydrogen is pressure between a first regulator provided on a hydrogen supply pipe connected to a hydrogen storage unit in which the hydrogen is stored and the hydrogen burner.

17. The method of preventing the backflash in the premixed hydrogen burner in the system of claim 3, the method including:

preparing, by the control unit, ignition of the hydrogen burner by supplying the hydrogen and the combustion air, which are premixed, to the pipe;

performing, by the control unit, the ignition of the hydrogen burner; and completing, by the control unit, the ignition of the hydrogen burner, wherein the first control is performed in response that the hydrogen burner failing to ignite, wherein in response that the hydrogen burner is ignited and in response that the backflash detection and spark detection sensor does not detect a flame that results from the combustion or at least one of the backflash-detection ion prober, the backflash-detection vibration sensor, and the backflash-detection pressure sensor detects the backflash, the first control is performed.

18. The method of claim 13, wherein the control unit is configured for performing a second control including:

determining an amount of load on the hydrogen burner using a difference between a temperature measured at a predetermined target point in the hydrogen burner and a predetermined temperature value;

presetting an upper limit of an absolute value of an amount of change in the load, and in response that the absolute value exceeds the pre-set upper limit, adjusting a new pre-set upper limit to 20% or smaller of the pre-set upper limit;

determining an amount of change in the load that indicates a difference between an amount of the load which is newly determined and an amount of the load which is determined previously; and regulating the amount of the combustion air flowing to be supplied earlier than the amount of the hydrogen flowing to be supplied in response that the absolute value of the amount of change in the load is greater than 0, and regulating the amount of the hydrogen flowing to be supplied earlier than the amount of the combustion air flowing to be supplied when the absolute value of the amount of change in the load is smaller than 0.

19. The method of claim 18, wherein an alarm is set off in response that receiving a feedback signal after the second control starts takes a predetermined time period or longer than the predetermined time period.

* * * * *